US007066243B2

(12) United States Patent
Horiuchi et al.

(10) Patent No.: US 7,066,243 B2
(45) Date of Patent: Jun. 27, 2006

(54) EVAPORATOR, MANUFACTURING METHOD OF THE SAME, HEADER FOR EVAPORATOR AND REFRIGERATION SYSTEM

(75) Inventors: Hirofumi Horiuchi, Oyama (JP); Ryoichi Hoshino, Oyama (JP); Noboru Ogasawara, Oyama (JP); Takashi Tamura, Oyama (JP); Takashi Terada, Oyama (JP); Futoshi Watanabe, Oyama (JP)

(73) Assignee: Showa Denko K.K., Tokyo (JP)

( * ) Notice: Subject to any disclaimer, the term of this patent is extended or adjusted under 35 U.S.C. 154(b) by 121 days.

(21) Appl. No.: 10/480,259

(22) PCT Filed: Jun. 17, 2002

(86) PCT No.: PCT/JP02/06046

§ 371 (c)(1),
(2), (4) Date: Dec. 18, 2003

(87) PCT Pub. No.: WO02/103263

PCT Pub. Date: Dec. 27, 2002

(65) Prior Publication Data

US 2004/0159121 A1 Aug. 19, 2004

Related U.S. Application Data

(60) Provisional application No. 60/303,145, filed on Jul. 6, 2001.

(30) Foreign Application Priority Data

Jun. 18, 2001 (JP) ..... 2001-183062

(51) Int. Cl.
*F28F 9/02* (2006.01)

(52) U.S. Cl. ..... 165/176; 165/174

(58) Field of Classification Search ..... 165/144, 165/174, 176

See application file for complete search history.

(56) References Cited

U.S. PATENT DOCUMENTS

| | | | | |
|---|---|---|---|---|
| 5,205,347 | A * | 4/1993 | Hughes | 165/176 |
| 5,761,808 | A * | 6/1998 | Patel et al. | 29/890.052 |
| 5,934,367 | A * | 8/1999 | Shimmura et al. | 165/174 |
| 6,189,604 | B1 * | 2/2001 | Yamauchi et al. | 165/140 |
| 6,615,588 | B1 * | 9/2003 | Hoecker | 60/752 |

FOREIGN PATENT DOCUMENTS

| | | |
|---|---|---|
| JP | 5-296606 | 11/1993 |
| JP | 9-166368 | 6/1997 |

(Continued)

*Primary Examiner*—Teresa J. Walberg
(74) *Attorney, Agent, or Firm*—Oblon, Spivak, McClelland, Maier & Neustadt, P.C.

(57) ABSTRACT

The evaporator includes the upper side and lower header members 10 and 50 disposed at the upper and lower end of the core 1. One end of each tube 6 constituting the upstream-side tube group P1 is connected to the inlet-side tank 11, while the other end to the lower header member 50. One end of each tube 7 constituting the downstream-side tube group P2 is connected to the outlet-side tank 12, while the other end to the lower header member 50. The refrigerant flowed into the inlet-side tank 11 is introduced into the outlet-side tank 12 by passing through the upstream-side tube group P1, the lower header member 50 and the downstream-side tube group P2, so that the refrigerant evaporates by exchanging heat with ambient air A. Accordingly, it improves the heat exchange performance and decreases the thickness.

56 Claims, 19 Drawing Sheets

FOREIGN PATENT DOCUMENTS

| | | |
|---|---|---|
| JP | 11-94398 | 4/1999 |
| JP | 11-337293 | 12/1999 |
| JP | 2000-203250 | 7/2000 |
| JP | 2001-66018 | 3/2001 |

* cited by examiner

EVAPORATOR, MANUFACTURING METHOD OF THE SAME, HEADER FOR EVAPORATOR AND REFRIGERATION SYSTEM

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/303,145 filed on Jul. 6, 2001 pursuant to 35 U.S.C. §111(b).

This application claims priority to Japanese Patent Application No. 2001-183062 filed on Jun. 18, 2001 and U.S. Provisional application No. 60/303,145 filed on Jul. 6, 2001, the disclosure of which is incorporated by reference in its entirety.

TECHNICAL FIELD

The present invention relates to, for example, an evaporator for car air-conditioners or room air-conditioners, a manufacturing method thereof, a header member for an evaporator and a refrigeration system.

BACKGROUND ART

A refrigeration system for car air-conditioners has a refrigeration cycle. In this cycle, a gaseous refrigerant of high temperature and high pressure sent out of a compressor is condensed by a condenser and then made into mist-like refrigerant including a gaseous phase and a liquid phase by decompressing means such as an expansion valve. Then, the mist-like refrigerant evaporates while passing through an evaporator. Thereafter, the evaporated refrigerant returns to the compressor.

As a conventional evaporator used in the aforementioned refrigeration system, a laminated type evaporator is mainly used. The laminated type evaporator includes a plurality of tubular elements laminated in laminating direction and fins each interposed between the adjacent tubular elements, wherein each tubular element is formed by coupling a pair of plate-shaped formed plates in a face-to-face manner.

This kind of laminated type evaporator is large in cooling capacity and is low in air-side pressure loss, and therefore has excellent characteristics. In recent years, in view of an odor problem of an inside of a car or the like, an odor removal filter is sometimes installed in front of the evaporator. In this case, in order to secure the mounting space for such a filter, the evaporator tends to be required to reduce the thickness.

In meeting such a demand of reducing the thickness of the aforementioned laminated type evaporator, the following drawbacks have became clear.

First, since each tubular element having heat exchanging passages is formed by coupling a pair of plate-shaped formed plates formed by drawing processing using a press in a face-to-face manner, the portions where the pair of formed plates directly contact, i.e., the portions other than the heat exchanging passages, likely increase. Consequently, the cross-sectional area of the refrigerant passages decrease, which may cause high refrigerant side pressure drop and deteriorate the performance. As this countermeasure, it is considered to increase the height of the refrigerant passage by increasing the drawing amount of the formed plate to thereby enlarge the cross-sectional area of the passage. However, according this proposal, the tubular element becomes thick, and therefore the air-side passage between the adjacent tubular elements becomes smaller, resulting in a reduced size of the fin disposed in the air-side passage. Consequently, there is a possibility that the air-side pressure drop increases and that the heat transferring area of the fin decreases, which in turn causes a deterioration of the performance.

Second, in the aforementioned laminated type evaporator, the fin does not comes into contact with a portion where the pair of formed plates directly contact each other, and therefore surface efficiency deteriorates. Accordingly, the more the thickness of the tubular element becomes, the more the rate of non-contact portion of the fin increases. This may cause a deterioration of the cooling performance.

Third, in the aforementioned laminated type evaporator, since the tank portion and the tube portion (heat exchanging medium passage portion) are integrally formed in the plate-shaped formed plate, the tank portion where higher pressure resistance is required is also formed by a drawing processing. Accordingly, the thickness of the tank portion tends to become thinner than that of the tube portion (heat exchange medium passage portion). Accordingly, It is necessary to design the wall thickness on the basis of the tank portion. As a result, even if the tube portion has enough pressure resistance, it is impossible to further reduce the wall thickness, which may not meet the demand of reducing weight.

As will be apparent from the above, in a laminated type evaporator, it is difficult to further reduce the thickness while achieving sufficient performance.

The present invention was made in view of the aforementioned circumstances, it is an object of the present invention to provide an evaporator capable of reducing the weight and the size while maintaining sufficient heat exchanging performance, the manufacturing method of the evaporator, a header member for the evaporator and a refrigeration system.

Another objects of the present invention will be apparent from the following explanation.

DISCLOSURE OF INVENTION

According to the first aspect of the present invention, an evaporator comprises:

a core including an upstream-side heat exchanging tube group and a downstream-side heat exchanging tube group arranged front and rear, each of the heat exchanging tube groups including a plurality of heat exchanging tubes disposed parallel with each other at certain intervals;

an inlet-side tank disposed along one end side of the upstream-side heat exchanging tube group;

an outlet-side tank disposed along one end side of the downstream-side heat exchanging tube group; and a refrigerant turning member disposed along the other end side of both the heat exchanging tube groups, wherein each one end of the heat exchanging tubes constituting the upstream-side heat exchanging tube group is connected to the inlet-side tank, while the other end thereof is connected to the refrigerant turning member, and wherein each one end of the heat exchanging tubes constituting the downstream-side heat exchanging tube group is connected to the outlet-side tank, while the other end thereof is connected to the refrigerant turning member, whereby refrigerant flowed into the inlet-side tank is introduced into the outlet-side tank via the upstream-side heat exchanging tube group, the refrigerant turning member and the downstream-side heat exchanging tube group, while the refrigerant passing through both the heat exchanging tube groups evaporates by exchanging heat with ambient air.

In the evaporator of the present invention, since the refrigerant passage is formed into a U-shape by the upstream-side and downstream-side heat exchanging tube groups, the refrigerant pressure drop can be decreased. Accordingly, the refrigerant passage cross-sectional area can be reduced, and the tube height of the heat exchanging tube can be lowered. Furthermore, since the tube height can be lowered, the number of heat exchanging tubes can be increased without increasing the core dimension, resulting in an enhanced refrigerant dispersibility.

In the present invention, it is preferable that the inlet-side tank is provided with refrigerant distributing resistance means which distributes the refrigerant in a longitudinal direction of the inlet-side tank, or the outlet-side tank is provided with uneven-distribution-flow preventing resistance means which prevents uneven-distribution-flow of refrigerant.

In cases where these structures are adopted, the refrigerant passing through the heat exchanging tube groups is distributed equally throughout the core, and therefore the heat exchange can be performed efficiently throughout the core.

In order to attain the aforementioned object, according to the second aspect of the present invention, an evaporator comprises:

a core including an upstream-side heat exchanging tube group and a downstream-side heat exchanging tube group arranged front and rear, each of the heat exchanging tube groups including a plurality of heat exchanging tubes disposed parallel with each other at certain intervals;

an inlet-and-outlet-side header member disposed along one end side of both the heat exchanging tube groups; and a refrigerant-turn-side header member disposed along the other end side of both the heat exchanging tube groups, wherein an inside of the inlet-and-outlet-side header member is divided front and rear by a partition into a front-side portion and a rear-side portion, wherein the front-side portion constitutes an inlet-side tank and the rear-side portion constitutes an outlet-side tank, wherein one end of each of the heat exchanging tubes constituting the upstream-side heat exchanging tube group is connected to the inlet-side tank of the inlet-and-outlet-side header member, while the other end thereof is connected to the refrigerant-turn-side header member, and wherein one end of each of the heat exchanging tubes constituting the downstream-side heat exchanging tube group is connected to the outlet-side tank of the inlet-and-outlet-side header member, while the other end thereof is connected to the refrigerant-turn-side header member, whereby refrigerant flowed into the inlet-side tank is introduced into the outlet-side tank via the upstream-side heat exchanging tube group, the refrigerant-turn-side member and the downstream-side heat exchanging tube group, while the refrigerant passing through both the heat exchanging tube groups evaporates by exchanging heat with ambient air.

In the evaporator of this invention, since the refrigerant passage is formed into a simple U-shape like in the aforementioned evaporator, the refrigerant flow resistance can be decreased, resulting in enhanced refrigerant dispersibility.

In the evaporator according to the present invention, it is preferable that the inlet-and-outlet-side header member includes an inlet-and-outlet-side header plate to which one end of each of the heat exchanging tubes is fixed in a penetrated manner and an inlet-and-outlet-side header cover attached to the header plate so as to cover one surface side of the header plate.

Furthermore, in the present invention, it is preferable that the refrigerant-turn-side header member includes a refrigerant-turn-side header plate to which the other end of each of the heat exchanging tubes is fixed in a penetrated manner and a refrigerant-turn-side header cover attached to the header plate so as to cover the other surface of the header plate.

In the present invention, it is preferable to employ the following structures in order to enhance the refrigerant dispersibility.

That is, in the present invention, it is preferable that refrigerant distributing resistance means which distributes the refrigerant in a longitudinal direction of the inlet-side tank is provided in an inside of the inlet-side tank.

As the aforementioned refrigerant distributing resistance means, it is possible to employ a refrigerant distributing resistance plate which divides the inlet-side tank into an upper space and a lower space and has a plurality of refrigerant passage apertures formed at intervals along the longitudinal direction of the inlet-side tank.

Furthermore, it is preferable that the plurality of refrigerant passage apertures of the refrigerant distributing resistance plate include apertures different in size.

Furthermore, it is preferable that the inlet-and-outlet-side header member has a refrigerant inlet for introducing refrigerant into the inlet-side tank, and wherein the plurality of refrigerant passage apertures of the refrigerant distributing resistance plate are formed so that the refrigerant passage aperture increases in size as it goes away from the refrigerant inlet, or that the refrigerant inlet is formed at a longitudinal middle position of the inlet-side tank, and wherein the refrigerant passage apertures formed in the refrigerant distributing resistance plate and located apart from the refrigerant inlet is formed to have a size larger than a size of the refrigerant passage aperture located near the refrigerant inlet.

In the present invention, it is also possible to employ the structure that the refrigerant inlet is provided at a longitudinal end portion of the inlet-side tank.

In the present invention, it is preferable to employ the following structures in order to further enhance the refrigerant dispersibility.

That is, in the present invention, it is preferable that uneven-distribution-flow preventing resistance means for preventing uneven-refrigerant-flow is provided within the outlet-side tank of the inlet-and-outlet-side header member.

As this uneven-distribution-flow preventing resistance means, it is preferable to employ an uneven-distribution-flow preventing resistance plate which divides the outlet-side tank into an upper space and a lower space and has a plurality of refrigerant passage apertures formed at intervals along a longitudinal direction of the outlet-side tank.

Furthermore, in the present invention, it is preferable that a distance between adjacent refrigerant passage apertures formed in the uneven-distribution-flow preventing resistance plate falls within the range of 1 to 4 times as long as a distance between adjacent heat exchanging tubes.

In cases where this structure is employed, the refrigerant can be flowed evenly thorough the entire core, resulting in enhanced refrigeration performance.

Furthermore, in the present invention, it is preferable that the refrigerant passage apertures formed in the uneven-distribution-flow preventing resistance plate are offset from a widthwise central portion of the heat exchanging tube toward a windward side relative to an air introducing direction.

In cases where this structure is employed, it is possible to prevent the liquefied refrigerant flow from the inlet-and-outlet-side header member, resulting in a stable expansion valve control.

In the present invention, it is more preferable that the inlet-and-outlet-side header member has a refrigerant outlet through which refrigerant flows out of the outlet-side tank, and wherein a cross-sectional area of a refrigerant passage aperture located in the most distant position from the refrigerant outlet among the refrigerant passage apertures formed in the uneven-distribution-flow preventing resistance plate is set to 7 $mm^2$ or less.

In cases where this structure is employed, the dispersibility of the refrigerant can be further enhanced.

Furthermore, in the present invention, it is possible to employ the structure that the refrigerant outlet is provided at a longitudinal middle portion of the outlet-side tank, or that the refrigerant outlet is provided at a longitudinal end portion of the outlet-side tank.

Furthermore, in the present invention, it is preferable that a cross-sectional area between the uneven-distribution-flow preventing resistance plate and an end portion of the heat exchanging tube in the outlet-side tank is 1 to 5 times as large as a passage cross-sectional area of the heat exchanging tube.

That is, by employing this structure, it is possible to prevent an increase of flow resistance between the uneven-distribution-flow preventing resistance plate and an end portion of the heat exchanging tube and secure an appropriate space in the header member.

In the present invention, it is preferable that a total cross-sectional area of the refrigerant passage apertures formed in the uneven-distribution-flow preventing resistance plate is larger than a total passage cross-sectional area of the heat exchanging tubes at the downstream-side heat exchanging tube group.

In cases where this structure is employed, it is possible to prevent an increase of flow resistance and further enhance the dispersibility of the refrigerant.

Furthermore, in the present invention, in order to prevent an increase of flow resistance and further enhance the dispersibility of the refrigerant, it is preferable that each of the refrigerant passage aperture formed in the uneven-distribution-flow preventing resistance plate is formed into a round shape, or that the refrigerant passage aperture formed in the uneven-distribution-flow preventing resistance plate is formed into an ellipse shape or a rectangular shape having a major axis along a width direction of the heat exchanging tube.

In the present invention, it is preferable that corresponding heat exchanging tubes of both the heat exchanging tube groups are integrally connected, or that the heat exchanging tube is an extruded tube obtained by extrusion molding.

In the present invention, it is possible to employ the structure that a tube height of the heat exchanging tube falls within the range of from 0.75 to 1.5 mm.

According to the third aspect of the present invention, an evaporator comprises:

a core including an upstream-side heat exchanging tube group and a downstream-side heat exchanging tube group arranged front and rear, each of the heat exchanging tube group including a plurality of heat exchanging tubes disposed parallel with each other at certain intervals;

an inlet-and-outlet-side header member disposed along one end side of both the heat exchanging tube groups; and a refrigerant-turn-side header member disposed along the other end side of both the heat exchanging tube groups, wherein an inside of the inlet-and-outlet-side header member is divided into an inlet-side tank and an outlet-side tank, wherein the refrigerant-turn-side header member includes at least two press-formed metal plate members, wherein an inside of the refrigerant-turn-side header member is divided into an inflow-side tank and an outflow-side tank by a refrigerant-turn-side partition, and both the tanks being communicated by communication apertures provided in the partition, wherein one end of each of the heat exchanging tubes constituting the upstream-side heat exchanging tube group is connected to the inlet-side tank of the inlet-and-outlet-side header member, while the other end thereof is connected to the inflow-side tank of the refrigerant-turn-side header member, and wherein one end of each of the heat exchanging tubes constituting the downstream-side heat exchanging tube group is connected to the outlet-side tank of the inlet-and-outlet-side header member, while the other end thereof is connected to the outflow-side tank of the refrigerant-turn-side header member, whereby refrigerant flowed into the inlet-side tank is introduced into the outlet-side tank via the upstream-side heat exchanging tube group, the inflow-side tank, the apertures, the outflow-side tank and the downstream-side heat exchanging tube group, while the refrigerant passing through both the heat exchanging tube groups evaporates by exchanging heat with ambient air.

In the third aspect of the present invention, in the same way as in the first and second inventions, since the refrigerant passage is formed into a simple U-shape, the refrigerant pressure drop can be decreased, resulting in an enhanced refrigerant dispersibility. Furthermore, since the press-formed metal plate member is used as the inlet-and-outlet-side header member, the header material can be continuously manufactured from a coiled metal material, which can increase the productivity.

Furthermore, since the header material is constituted by a plate member, as this header material, it is possible to use a brazing sheet in which clad materials such as brazing materials or sacrificial materials laminated on at least one surface thereof. Thus, the brazability and corrosion resistance can be improved.

Furthermore, in the present invention, it is preferable that the refrigerant-turn-side header member includes a header plate to which one end of each of the heat exchanging tubes is fixed in a penetrated manner and a header cover attached to the header plate so as to cover one surface side of the header plate, and wherein the refrigerant-turn-side partition is formed by folding a widthwise middle portion of a metal plate member constituting the header cover along a longitudinal direction thereof.

That is, in cases where this structure is employed, since the partition can be integrally formed by press forming processing, the productivity can be further improved. Furthermore, since the partition is constituted by folded plate portions, enough strength can be achieved by the partition, resulting in further enhancing pressure resistance of the header member.

Furthermore, in the present invention, it is preferable that the refrigerant-turn-side partition has at a tip portion thereof engaging protrusions at certain intervals along a longitudinal direction thereof, wherein the header plate has at a widthwise middle portion thereof engaging apertures corresponding to the engaging protrusions at certain intervals along a longitudinal direction thereof, and wherein the engaging protrusions are inserted and fixed in the engaging apertures by caulking processing.

In cases where this structure is employed, the positioning of the header cover relative to the header plate can be performed more assuredly.

Furthermore, in the present invention, it is more preferable that the metal plate member constituting the refrigerant-turn-side header member is formed by an aluminum brazing sheet having an aluminum core and a brazing layer laminated on at least one side of the core.

That is, in cases where this structure is employed, the brazability of the entire evaporator can be further enhanced.

Furthermore, in the present invention, it is preferable that the brazing sheet has the brazing layer laminated at an external surface side thereof, and wherein the brazing layer contains zinc.

That is, in cases where this structure is employed, a sacrificial-corrosion layer can be formed on the external surface of the refrigerant-turn-side header member, resulting in an enhanced corrosion resistance.

Furthermore, in the present invention, it is preferable that a thickness of the header cover is thinner than that of the header plate.

That is, in cases where this structure is employed, the size and weight of the header member, or the entire evaporator, can be reduced while keeping enough pressure strength.

In the third aspect of the present invention, it is preferable that the inlet-and-outlet-side header member includes at least two press-formed metal plate members.

That is, in cases where this structure is employed, the productivity and brazability of the inlet-and-outlet-side header member can be further improved.

In the third aspect of the present invention, it is preferable to constitute the inlet-and-outlet-side header member as follows in the same way as in the refrigerant-turn-side header member.

That is, in the third aspect of the present invention, it is preferable that the inlet-and-outlet-side header member has a header plate to which an end portion of each of the exchanging tubes is fixed in a penetrated manner and a header cover attached to the header plate so as to cover one surface side thereof, and wherein the inlet-and-outlet-side partition is formed by folding a widthwise middle portion of a metal plate member constituting the header cover along a longitudinal direction thereof.

That is, in the third aspect of the present invention, it is preferable that the inlet-and-outlet-side partition has at a tip portion thereof engaging protrusions at certain intervals along a longitudinal direction thereof, wherein the header plate has at a widthwise middle portion thereof engaging apertures corresponding to the engaging protrusions at certain intervals along a longitudinal direction thereof, and wherein the engaging protrusions are inserted in and fixed to the engaging apertures by caulking processing.

Further, in the third aspect of the present invention, it is preferable that the metal plate member constituting the inlet-and-outlet-side header member is formed by an aluminum brazing sheet having a brazing layer laminated on at least one side thereof.

Further, in the third aspect of the present invention, it is preferable that the brazing sheet has the brazing layer laminated at an external surface side thereof, and wherein the brazing layer contains zinc.

Further, in the third aspect of the present invention, it is preferable that a thickness of the header cover is thinner than that of the header plate.

According to the fourth aspect of the present invention, an evaporator comprises:

a core including an upstream-side heat exchanging tube group and a downstream-side heat exchanging tube group arranged front and rear, each of the heat exchanging tube groups including a plurality of heat exchanging tubes disposed parallel with each other at certain intervals;

an inlet-and-outlet-side header member disposed along one end side of both the heat exchanging tube groups; and a refrigerant-turn-side header member disposed along the other end side of both the heat exchanging tube groups, wherein the inlet-and-outlet-side header member includes an inlet-and-outlet-side header plate, an inlet-and-outlet-side header cover attached to the header plate so as to cover one surface side of the header plate and a partition for dividing an inside of the inlet-and-outlet-side header member into an inlet-side tank and an outlet-side tank, wherein the refrigerant-turn-side header member includes a refrigerant-turn-side header plate and a refrigerant-turn-side header cover attached to the header plate so as to cover one surface side of the header plate, one of the refrigerant-turn-side header plate and the refrigerant-turn-side header cover being formed by a press-formed metal plate member, and the other thereof being formed by an extruded molded article, wherein one end of each of the heat exchanging tubes constituting the upstream-side heat exchanging tube group is fixed to the inlet-and-outlet-side header plate in a penetrated manner to thereby be connected to the inlet-side tank, while the other end thereof is connected to the refrigerant-turn-side header plate in a penetrated manner, wherein one end of each of the heat exchanging tubes constituting the downstream-side heat exchanging tube group is fixed to the inlet-and-outlet-side header member to thereby be connected to the outlet-side tank, while the other end thereof is connected to the refrigerant-turn-side header member in a predetermined manner, whereby refrigerant flowed into the inlet-side tank is introduced into the outlet-side tank via the upstream-side heat exchanging tube group, the refrigerant-turn-side header member and the downstream-side heat exchanging tube group, while the refrigerant passing through both the heat exchanging tube groups evaporates by exchanging heat with ambient air.

In the fourth aspect of the present invention, in the same way as in the third aspect of the present invention, since the refrigerant passage is formed into a simple U-shape, the refrigerant pressure drop can be reduced and the dispersibility of the refrigerant can be increased. Furthermore, in the refrigerant-turn-side header member, the productivity, brazability and corrosion resistance can be improved.

In the fourth aspect of the present invention, it is preferable that one of the inlet-and-outlet-side header plate and the inlet-and-outlet-side header cover is formed by a press-formed metal plate member and the other thereof is formed by an extruded molded article.

In cases where this structure is employed, in the inlet-and-outlet-side header cover, the productivity and brazability can also be improved.

According to the fifth aspect of the present invention, a method of manufacturing an evaporator comprises the steps of:

a step of preparing a plurality of heat exchanging tubes constituting an upstream-side heat exchanging tube group and a downstream-side heat exchanging tube group to be disposed front and rear;

a step of preparing an inlet-side tank to be disposed along one end side of the upstream-side heat exchanging tube group;

a step of preparing an outlet-side tank to be disposed along one end side of the downstream-side heat exchanging tube group;

a step of preparing a refrigerant turning member to be disposed along the other end side of both the heat exchanging tubes groups;

a step of brazing one end of each of the heat exchanging tubes constituting the upstream-side heat exchanging tube group to the inlet-side tank;

a step of brazing the other end of each of the heat exchanging tubes constituting the upstream-side heat exchanging tube group to the refrigerant turning member;

a step of brazing one end of each of the heat exchanging tubes constituting the downstream-side heat exchanging tube group; and a step of brazing the other end of each of the heat exchanging tubes constituting the downstream-side heat exchanging tube group to the refrigerant turning member;

wherein refrigerant flowed into the inlet-side tank is introduced into the outlet-side tank by passing through the upstream-side heat exchanging tube group, the refrigerant turning member and the downstream-side heat exchanging tube group, and wherein the refrigerant passing through both the heat exchanging tube groups constitutes a refrigerant circuit in which the refrigerant evaporates by exchanging heat with ambient air.

In the fifth aspect of the present invention, the evaporator according to the first aspect of the present invention can be manufactured assuredly.

In the fifth aspect of the present invention, it is preferable that the brazing steps are collectively performed by furnace brazing processing.

The sixth aspect of the present invention specifies one embodiment of the manufacturing process of the evaporator according to the second aspect of the present invention.

That is, according to the sixth aspect of the present invention, a method of manufacturing an evaporator comprises the steps of:

a step of preparing heat exchanging tubes constituting an upstream-side heat exchanging tube group and a downstream-side heat exchanging tube group to be disposed front and rear;

a step of preparing an inlet-and-outlet-side header member to be disposed along one end side of both the heat exchanging tube groups, wherein an inside of the header member is divided by a partition front and rear into one side space constituting an inlet-side tank and the other side space constituting an outlet-side tank;

a step of preparing a refrigerant-turn-side header member to be disposed along the other end side of both the heat exchanging tube groups;

a step of brazing one end of each of the heat exchanging tubes constituting the upstream-side heat exchanging tube group to an inlet-side tank of the inlet-and-outlet-side header;

a step of brazing the other end of each of the heat exchanging tubes constituting the upstream-side heat exchanging tube group to the refrigerant-turn-side header member;

a step of brazing one end of each of the heat exchanging tubes constituting the downstream-side heat exchanging tube group to the outlet-side tank of the inlet-and-outlet-side header; and a step of brazing the other end of each of the heat exchanging tubes of the downstream-side heat exchanging tube group to the refrigerant-turn-side header member;

wherein refrigerant flowed into the inlet-side tank is introduced into the outlet-side tank by passing through the upstream-side heat exchanging tube group, the refrigerant-turn-side header member and the downstream-side heat exchanging tube group, and wherein the refrigerant passing through both the heat exchanging tube groups constitutes a refrigerant circuit in which the refrigerant evaporates by exchanging heat with ambient air.

According to the sixth aspect of the present invention, the evaporator according to the second aspect of the present invention can be manufactured assuredly.

In the sixth aspect of the present invention, it is preferable that the brazing steps are collectively performed by furnace brazing processing.

The seventh aspect of the present invention specifies an embodiment of the manufacturing process of the evaporator according to the third aspect of the present invention.

That is, according to the seventh aspect of the present invention, the method comprises the steps of:

a step of preparing heat exchanging tubes constituting an upstream-side heat exchanging tube group and a downstream-side heat exchanging tube group to be disposed front and rear;

a step of preparing an inlet-and-outlet-side header member to be disposed along one end of both the heat exchanging tube groups, an inside of the header member being divided into an inlet-side tank and an outlet-side tank;

a step of preparing a refrigerant-turn-side header member to be disposed along the other end side of both the heat exchanging tube groups, the refrigerant-turn-side header member including at least two press-formed metal plate members, and an inside of the header member being divided by a refrigerant-turn-side partition into an inflow-side tank and an outflow-side tank, and the both tanks being communicated each other via communication apertures formed in the partition;

a step of brazing one end of each of the heat exchanging tubes constituting the upstream-side heat exchanging tube group to an inlet-side tank of the inlet-and-outlet-side header;

a step of brazing the other end of each of the heat exchanging tubes constituting the upstream-side heat exchanging tube group to an inflow-side tank of the refrigerant-turn-side header member;

a step of brazing one end of each of the heat exchanging tubes constituting the downstream-side heat exchanging tube group to the outlet-side tank of the inlet-and-outlet-side header; and a step of brazing the other end of each of the heat exchanging tubes of the downstream-side heat exchanging tube group to an outflow-side tank of the refrigerant-turn-side header member;

wherein refrigerant flowed into the inlet-side tank is introduced into the outlet-side tank by passing through the upstream-side heat exchanging tube group, the inflow-side tank, the communication apertures, the outflow-side tank and the downstream-side heat exchanging tube group, and wherein the refrigerant passing through both the heat exchanging tube groups constitutes a refrigerant circuit in which the refrigerant evaporates by exchanging heat with ambient air.

According to the seventh aspect of the present invention, the evaporator according to the third aspect of the present invention can be manufactured assuredly.

In the seventh aspect of the present invention, it is preferable that the brazing steps are collectively performed by furnace brazing processing.

The eighth aspect of the present invention specifies an embodiment of the manufacturing process of the evaporator according to the fourth aspect of the present invention.

According to the eighth aspect of the present invention, a method of manufacturing an evaporator comprises the steps of:

a step of preparing heat exchanging tubes constituting an upstream-side heat exchanging tube group and a downstream-side heat exchanging tube group to be disposed front and rear;

a step of preparing an inlet-and-outlet-side header member to be disposed along one end of both the heat exchanging tube groups, wherein the header member includes an inlet-and-outlet-side header plate, an inlet-and-outlet-side header cover attached to the header plate so as to cover one surface side thereof and a partition for dividing an inside of the inlet-and-outlet-side header member into an inlet-side tank and an outlet-side tank;

a step of preparing a refrigerant-turn-side header member to be disposed along the other end side of both the heat exchanging tube groups, wherein the refrigerant-turn-side header member includes a refrigerant-turn-side header plate and a refrigerant-turn-side header cover attached to the header plate so as to cover one side surface thereof, one of the refrigerant-turn-side header plate and the refrigerant-turn-side header cover being made of a press-formed metal plate, and the other thereof being made of an extruded molded article;

a step of brazing one end of each of the heat exchanging tubes constituting the upstream-side heat exchanging tube group to the header plate of the inlet-and-outlet-side header to thereby be connected to the inlet-side tank;

a step of brazing the other end of each of the heat exchanging tubes constituting the upstream-side heat exchanging tube group to the header plate of the refrigerant-turn-side header member;

a step of brazing one end of each of the heat exchanging tubes constituting the downstream-side heat exchanging tube group to the header plate of the inlet-and-outlet-side header to thereby be connected to the outlet-side tank; and a step of brazing the other end of each of the heat exchanging tubes constituting the downstream-side heat exchanging tube group to the header plate of the refrigerant-turn-side header member;

wherein refrigerant flowed into the inlet-side tank is introduced into the outlet-side tank by passing through the upstream-side heat exchanging tube group, the refrigerant-turn-side header member and the downstream-side heat exchanging tube group, and wherein the refrigerant passing through both the heat exchanging tube groups constitutes a refrigerant circuit in which the refrigerant evaporates by exchanging heat with ambient air.

According to the eight aspect of the present invention, the evaporator according to the fourth aspect of the present invention can be manufactured assuredly.

In the eighth aspect of the present invention, in order to improve the productivity, it is preferable that the brazing steps are collectively performed by furnace brazing processing.

Furthermore, in the eighth aspect of the present invention, it is preferable that a step of forming a zinc diffusion layer on a surface of each of the header members is performed by applying a flux containing zinc on the surface before performing the furnace brazing processing.

In this case, a sacrifice layer can be assuredly formed on the external surface of the header member, which can improve the corrosion resistance.

The ninth aspect of the present invention specifies an inlet-and-outlet-side header member applicable to the aforementioned third or fourth aspect of the present invention.

That is, according to the ninth aspect of the present invention, an inlet-and-outlet-side header member for an evaporator with a core including an upstream-side heat exchanging tube group and a downstream-side heat exchanging tube group disposed front and rear, each of heat exchanging tube group including a plurality of heat exchanging tubes arranged in parallel with each other at certain intervals, comprises:

a header plate for fixing an end portion of each of the heat exchanging tubes in a penetrated manner;

a header cover attached to the header plate so as to cover one surface side thereof; and a partition for forming an inlet-side tank and an outlet-side tank by dividing a hollow portion surrounded by the header plate and the header cover front and rear;

wherein at least one of the header plate and the the header cover is a press-formed metal plate, and wherein refrigerant flowed into the inlet-side tank is introduced into the upstream-side heat exchanging tube group, while refrigerant passing through the downstream-side heat exchanging tube group is introduced into the outlet-side tank.

In the ninth aspect of the present invention, it is possible to employ the structure that the header plate and the header cover are formed by a press-formed metal plate member, and wherein the partition is integrally formed with the header cover by folding a widthwise middle portion of the metal plate constituting the header cover along a longitudinal direction thereof, or that one of the header plate and the header cover is a press-formed metal plate, and the other thereof is an extruded molded article.

The tenth aspect of the present invention specifies a refrigerant-turn-side header member applicable to the aforementioned third or fourth aspect of the present invention.

That is, according to the tenth aspect of the present invention, a refrigerant-turn-side header member for an evaporator with a core including an upstream-side heat exchanging tube group and a downstream-side heat exchanging tube group disposed front and rear, each of heat exchanging tube group including a plurality of heat exchanging tubes arranged in parallel with each other at certain intervals, comprises:

a header plate for fixing an end portion of each of the heat exchanging tubes in a penetrated manner;

a header cover attached to the header plate so as to cover one surface side thereof; and a partition for forming an inflow-side tank and an outflow-side tank by dividing a hollow portion surrounded by the header plate and the header cover front and rear, the partition having communication apertures for communicating with the tanks;

wherein at least one of the header plate and the the header cover is a press-formed metal plate, and wherein refrigerant passing through the upstream-side heat exchanging tube group is introduced into the inflow-side tank and then introduced into the outflow-side tank via the communication apertures, while the refrigerant in the outflow-side tank is introduced into the downstream-side heat exchanging tube group.

In the tenth aspect of the present invention, it is possible to employ the structure that both of the header plate and the header cover are formed by a press-formed metal plate member respectively, and wherein the partition is integrally formed with the header cover by folding a widthwise middle portion of the metal plate constituting the header cover along a longitudinal direction thereof, or that one of the header plate and the header cover is a press-formed metal plate, and the other thereof is an extruded molded article.

The eleventh aspect of the present invention specifies a refrigeration system utilizing the evaporator according to the first aspect of the present invention.

According to the eleventh aspect of the present invention, a refrigeration system in which refrigerant compressed by a compressor is condensed by a condenser into a condensed refrigerant, then the condensed refrigerant is passed through a decompressing device into a decompressed refrigerant, and thereafter the decompressed refrigerant is evaporated by an evaporator and then returnes to the compressor, the evaporator comprises:

a core including an upstream-side heat exchanging tube group and a downstream-side heat exchanging tube group arranged front and rear, each of the heat exchanging tube groups including a plurality of heat exchanging tubes disposed parallel with each other at certain intervals;

an inlet-side tank disposed along one end side of the upstream-side heat exchanging tube group;

an outlet-side tank disposed along one end side of the downstream-side heat exchanging tube group; and a refrigerant turning member disposed along the other end side of both the heat exchanging tube groups, wherein each one end of the heat exchanging tubes constituting the upstream-side heat exchanging tube group is connected to the inlet-side tank, while the other end thereof is connected to the refrigerant turning member, and wherein each one end of the heat exchanging tubes constituting the downstream-side heat exchanging tube group is connected to the outlet-side tank, while the other end thereof is connected to the refrigerant turning member, whereby refrigerant flowed into the inlet-side tank is introduced into the outlet-side tank via the upstream-side heat exchanging tube group, the refrigerant turning member and the downstream-side heat exchanging tube group, while the refrigerant passing through both the heat exchanging tube groups evaporates by exchanging heat with ambient air.

The twelfth aspect of the present invention specifies a refrigeration system utilizing the evaporator according to the second aspect of the present invention.

According to the twelfth aspect of the present invention, a refrigeration system in which refrigerant compressed by a compressor is condensed by a condenser into a condensed refrigerant, then the condensed refrigerant is passed through a decompressing device into a decompressed refrigerant, and thereafter the decompressed refrigerant is evaporated by an evaporator and then returns to the compressor, an evaporator, comprises:

a core including an upstream-side heat exchanging tube group and a downstream-side heat exchanging tube group arranged front and rear, each of the heat exchanging tube groups including a plurality of heat exchanging tubes disposed parallel with each other at certain intervals;

an inlet-and-outlet-side header member disposed along one end side of both the heat exchanging tube groups; and a refrigerant-turn-side header member disposed along the other end side of both the heat exchanging tube groups, wherein an inside of the inlet-and-outlet-side header member is divided front and rear by a partition into a front-side portion and a rear-side portion, wherein the front-side portion constitutes an inlet-side tank and the rear-side portion constitutes an outlet-side tank, wherein one end of each of the heat exchanging tubes constituting the upstream-side heat exchanging tube group is connected to the inlet-side tank of the inlet-and-outlet-side header member, while the other end thereof is connected to the refrigerant-turn-side header member, and wherein one end of each of the heat exchanging tubes constituting the downstream-side heat exchanging tube group is connected to the outlet-side tank of the inlet-and-outlet-side header member, while the other end thereof is connected to the refrigerant-turn-side header member, whereby refrigerant flowed into the inlet-side tank is introduced into the outlet-side tank via the upstream-side heat exchanging tube group, the refrigerant-turn-side member and the downstream-side heat exchanging tube group, while the refrigerant passing through both the heat exchanging tube groups evaporates by exchanging heat with ambient air.

The thirteenth aspect of the present invention specifies a refrigeration system utilizing the evaporator according to the third aspect of the present invention.

According to the thirteenth aspect of the present invention, a refrigeration system in which refrigerant compressed by a compressor is condensed by a condenser into a condensed refrigerant, then the condensed refrigerant is passed through a decompressing device into a decompressed refrigerant, and thereafter the decompressed refrigerant is evaporated by an evaporator and then returns to the compressor, an evaporator, comprises:

a core including an upstream-side heat exchanging tube group and a downstream-side heat exchanging tube group arranged front and rear, each of the heat exchanging tube group including a plurality of heat exchanging tubes disposed parallel with each other at certain intervals;

an inlet-and-outlet-side header member disposed along one end side of both the heat exchanging tube groups; and a refrigerant-turn-side header member disposed along the other end side of both the heat exchanging tube groups, wherein an inside of the inlet-and-outlet-side header member is divided into an inlet-side tank and an outlet-side tank, wherein the refrigerant-turn-side header member includes at least two press-formed metal plate members, wherein an inside of the refrigerant-turn-side header member is divided into an inflow-side tank and an outflow-side tank by a refrigerant-turn-side partition, and both the tanks being communicated by communication apertures provided in the partition, wherein one end of each of the heat exchanging tubes constituting the upstream-side heat exchanging tube group is connected to the inlet-side tank of the inlet-and-outlet-side header member, while the other end thereof is connected to the inflow-side tank of the refrigerant-turn-side header member, and wherein one end of each of the heat exchanging tubes constituting the downstream-side heat exchanging tube group is connected to the outlet-side tank of the inlet-and-outlet-side header member, while the other end thereof is connected to the outflow-side tank of the refrigerant-turn-side header member, whereby refrigerant flowed into the inlet-side tank is introduced into the outlet-side tank via the upstream-side heat exchanging tube group, the inflow-side tank, the apertures, the outflow-side tank and the downstream-side heat exchanging tube group, while the refrigerant passing through both the heat exchanging tube groups evaporates by exchanging heat with ambient air.

The fourteenth aspect of the present invention specifies a refrigeration system utilizing the evaporator according to the fourth aspect of the present invention.

According to the fourteenth aspect of the present invention, a refrigeration system in which refrigerant compressed by a compressor is condensed by a condenser into a condensed refrigerant, then the condensed refrigerant is passed through a decompressing device into a decompressed refrigerant, and thereafter the decompressed refrigerant is evaporated by an evaporator and then returns to the compressor, an evaporator, comprises:

a core including an upstream-side heat exchanging tube group and a downstream-side heat exchanging tube group arranged front and rear, each of the heat exchanging tube groups including a plurality of heat exchanging tubes disposed parallel with each other at certain intervals;

an inlet-and-outlet-side header member disposed along one end side of both the heat exchanging tube groups; and a refrigerant-turn-side header member disposed along the other end side of both the heat exchanging tube groups, wherein the inlet-and-outlet-side header member includes an inlet-and-outlet-side header plate, an inlet-and-outlet-side header cover attached to the header plate so as to cover one surface side of the header plate and a partition for dividing an inside of the inlet-and-outlet-side header member into an inlet-side tank and an outlet-side tank, wherein the refrigerant-turn-side header member includes a refrigerant-turn-side header plate and a refrigerant-turn-side header cover attached to the header plate so as to cover one surface side of the header plate, one of the refrigerant-turn-side header plate and the refrigerant-turn-side header cover being formed by a press-formed metal plate member, and the other thereof being formed by an extruded molded article, wherein one end of each of the heat exchanging tubes constituting the upstream-side heat exchanging tube group is fixed to the inlet-and-outlet-side header plate in a penetrated manner to thereby be connected to the inlet-side tank, while the other end thereof is connected to the refrigerant-turn-side header plate in a penetrated manner, wherein one end of each of the heat exchanging tubes constituting the downstream-side heat exchanging tube group is fixed to the inlet-and-outlet-side header member to thereby be connected to the outlet-side tank, while the other end thereof is connected to the refrigerant-turn-side header member in a predetermined manner, whereby refrigerant flowed into the inlet-side tank is introduced into the outlet-side tank via the upstream-side heat exchanging tube group, the refrigerant-turn-side header member and the downstream-side heat exchanging tube group, while the refrigerant passing through both the heat exchanging tube groups evaporates by exchanging heat with ambient air.

BEST MODE FOR CARRYING OUT THE INVENTION

First Embodiment

Figure 1B:
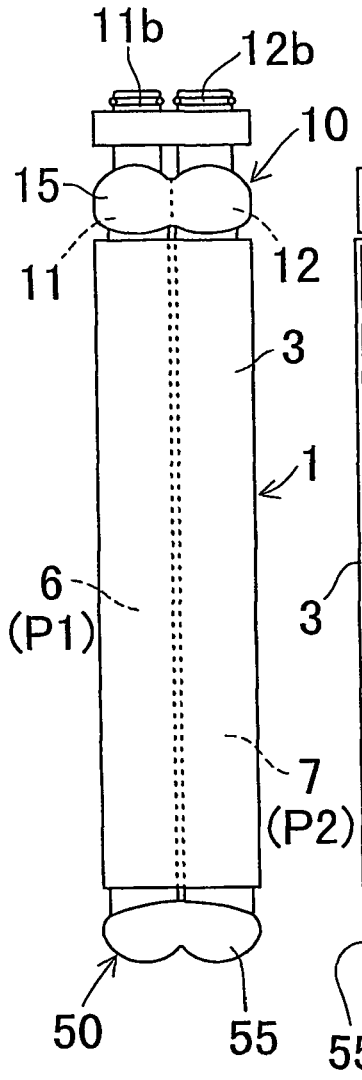
FIG. 1B is a side view showing the evaporator of the first embodiment.

FIGS. 1 to 6 show an evaporator according to a first embodiment of the present invention. As shown in these figures, this evaporator is used as an evaporator for a refrigeration system for car air-conditioners. As shown in these figures, the evaporator includes a core 1 constituting a heat exchanging portion, an upper header member 10 as an inlet-and-outlet-side header member disposed along the upper end of the core 1 and a lower header member 50 as a refrigerant-turn-side header member disposed along the lower end of the core 1 as a fundamental structure.

The core 1 is provided with a plurality of flat tubular elements 5 and a plurality of corrugated fins 2.

Figure 7:
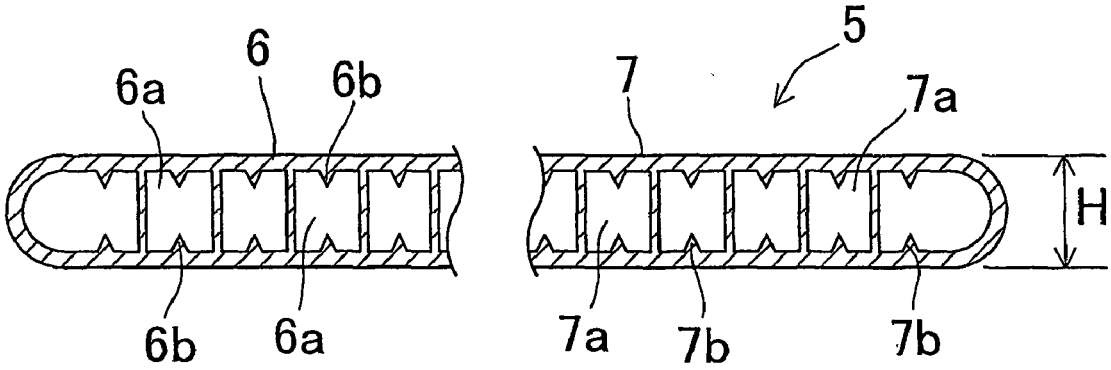
FIG. 7 is an enlarged cross-sectional view showing the heat exchanging tube applied to the evaporator of the first embodiment.
Figure 8:
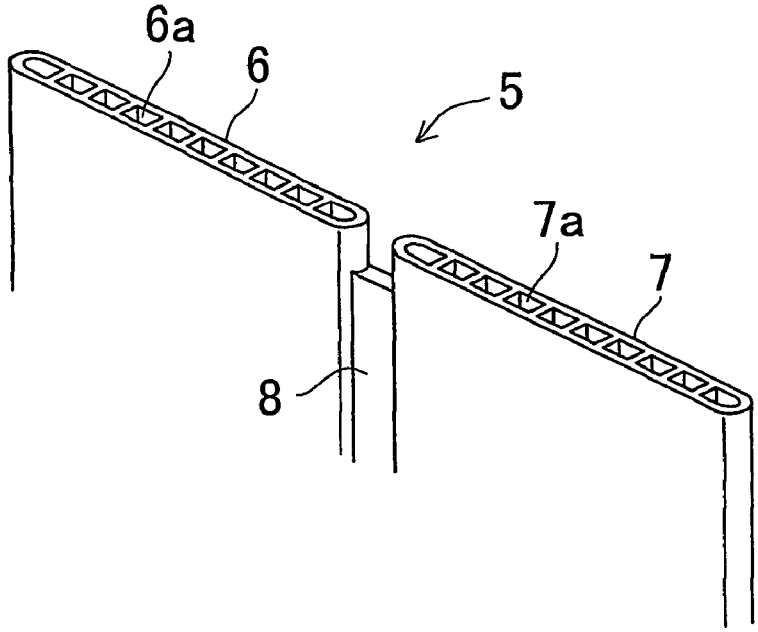
FIG. 8 is a perspective view showing the tube member applied to the evaporator of the first embodiment.
Figure 9:
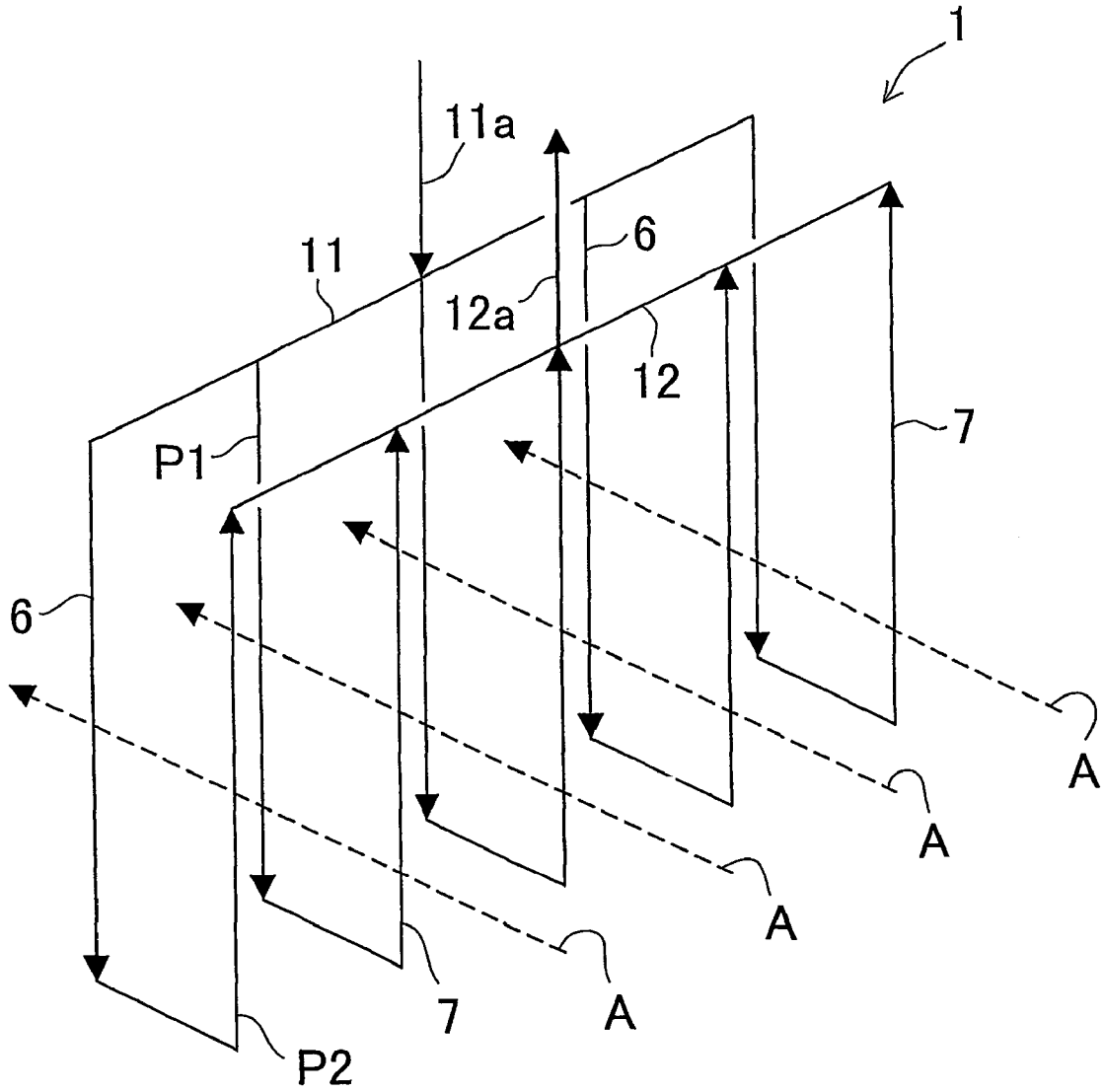
FIG. 9 is a perspective view showing the flow of the refrigerant in the evaporator of the first embodiment.

As shown in FIGS. 7 and 8, the tubular member 5 is constituted by an extruded molded article of aluminum or its alloy integrally provided with a downstream-side flat heat exchanging tube 7 to be disposed at the front row side of the core 1, an upstream-side flat heat exchanging tube 6 arranged side-by-side with the downstream-side heat exchanging tube 7 at the rear row side of the core 1 and a connecting piece 8 which connects these tubes 6 and 7.

Each heat exchanging tube 6 and 7 is provided with a plurality of heat exchanging passages 6*a* and 7*a* arranged in parallel each other and extending along the longitudinal direction thereof (i.e., the direction of extrusion). On the inner peripheral surface of each heat exchanging passage 6*a* and 7*a*, inwardly protruded inner fins 6*b* or 7*b* are integrally formed.

The core 1 is formed by alternatively laminating the aforementioned tubular members 5 and corrugated fins 2 in the core width direction and disposing a side plate 3 on the external side of the respective outermost corrugated fin 2. Thus, each heat exchanging tube 6 located at the upstream-side among the plurality of tubular members 5 form an upstream-side heat exchanging tube group as a first pass P1, while each heat exchanging tube 7 located at the downstream-side form a downstream-side heat exchanging tube group as a second pass P2.

In this embodiment, it is preferable that the tube height H is set to 0.75 to 1.5 mm. The lower limit of the tube height H is preferably set to 1.0 mm or more.

Furthermore, it is preferable that each width of the heat exchanging tube 6 and 7 is set to 12 to 18 mm. As for the tubular member 5 integrally provided with the tubes 6 and 7, the width is preferably set to 32 to 38 mm. Furthermore, as for the wall thickness of the peripheral wall of the tube 6 and 7, it is preferable that the wall thickness is set to 0.175 to 0.275 mm. Furthermore, as for the wall thickness of the partitioning wall for dividing the heat exchanging passage 6*a* and 7*a* in the tube 6 and 7, it is preferable that the wall thickness is set to 0.175 to 0.275 mm, while the pitch of the partitioning wall is preferably set to 0.5 to 3.0 mm. Furthermore, as for the radius of curvature R of the external side surface of the side portion of the heat exchanging tube 6 and 7, it is preferable to set to 0.35 to 0.75 mm.

Furthermore, the height (fin height) of the corrugated fin 2 is preferably set to 7.0 to 10 mm, and the pitch (fin pitch) of the fin 2 is preferably set to 1.3 to 1.8 mm.

That is, in cases where the structure falling within the numerical scope is employed, good heat exchange performance can be obtained.

In this embodiment, although heat exchanging tubes 6 and 7 are integrally formed, the present invention is not limited to it. The present invention allows forming both the tubes 6 and 7 separately. Furthermore, the heat exchanging tube 6 and 7 is not limited to an extruded molded article. For example, the heat exchanging tube 6 and 7 may be a bend-formed article having inner fins obtained by bending a plate member or a roll-formed article having a heat exchanging passage obtained by rolling a plate member.

Furthermore, in this invention, a plate fin may be used in place of the corrugated fin 2.

As shown in FIGS. 1 to 6, the upper header member 10 is disposed along the upper end portion of the core 1 along the core width direction, and includes a header plate 20, a header cover 30, a refrigerant distributing resistance plate 41 and an uneven-distribution-flow preventing resistance plate 42.

At the front-half region and the rear-half region of the header plate 20, a plurality of tube mounting apertures 21 are formed at certain intervals along the longitudinal direction, respectively.

The header cover 30 is disposed so as to cover the upper surface side of the header plate 20 from the above. At the middle position of the lower surface in the fore-and-aft direction, a partitioning wall 31 is integrally formed so as to extend along the longitudinal direction (the core width direction).

By the space surrounded by the header plate 20 and the header cover 30 and positioned in front of the partitioning wall 31, an outlet-side tank 12 having a tube shape and extending in the core width direction is formed. On the other hand, by the space surrounded by the header plate 20 and the header cover 30 and positioned behind the partitioning wall 31, an inlet-side tank 11 having a tube shape and extending in the core width direction is formed.

Furthermore, a refrigerant inlet 11*a* is formed at the longitudinal middle portion of the header cover 30 of the inlet-side tank 11, while a refrigerant outlet 12*a* is formed at the portion of the header cover 30 of the outlet-side tank 12.

Furthermore, in the inlet-side tank 11, a refrigerant distributing resistance plate 41 is provided so as to divide the inner space into an upper space and a lower space. This refrigerant distributing resistance plate 41 is equipped with a plurality of refrigerant passage apertures 41*a* formed at certain intervals in the longitudinal direction. In the refrigerant passage apertures 41*a*, the diameter of the aperture 41*a* near the refrigerant inlet 11*a*, or the diameter of the aperture 41*a* located at the longitudinal central portion, is formed to be the smallest, while the diameters of the other apertures 41*a* are formed to become gradually larger as it goes toward the longitudinal end portion from the longitudinal central portion.

In the outlet-side tank 12, an uneven-distribution-flow preventing resistance plate 42 is provided so as to divide the inside space into an upper space and a lower space. This uneven-distribution-flow preventing resistance plate 42 is provided with a plurality of refrigerant passage apertures

42*a*, which are the same in diameter, at certain intervals along the longitudinal direction.

Figure 1A:
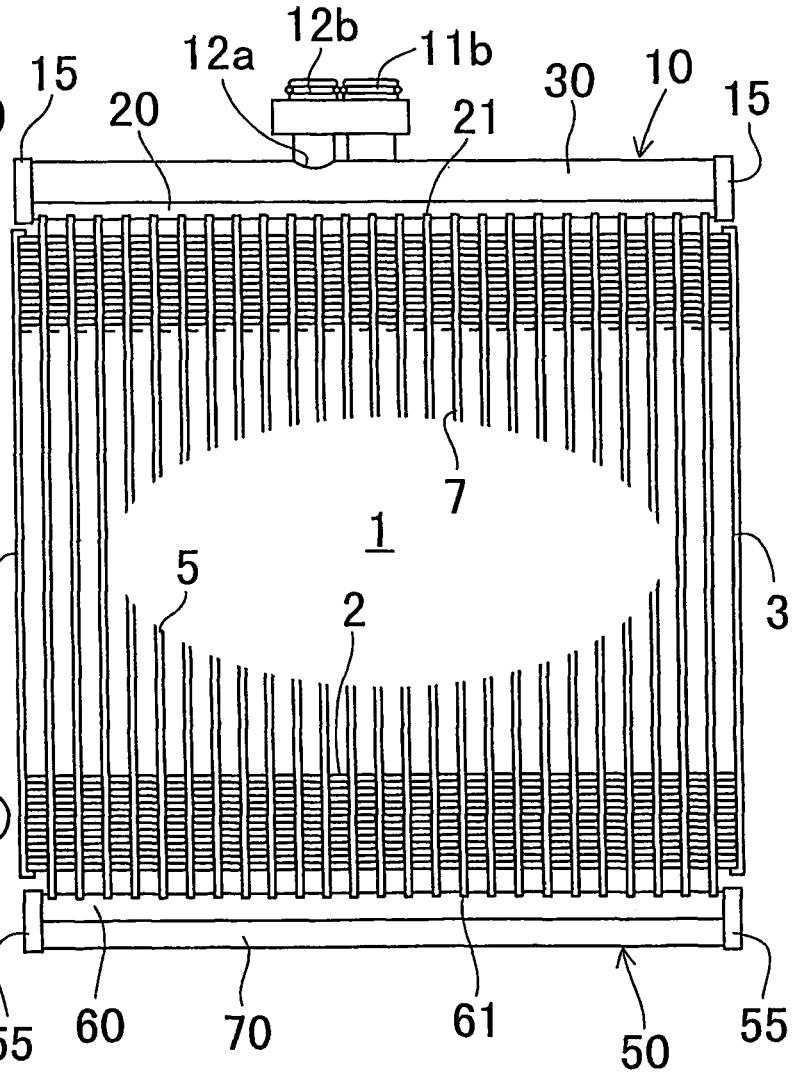
FIG. 1A shows a front view showing a first embodiment according to the present invention.
Figure 2:
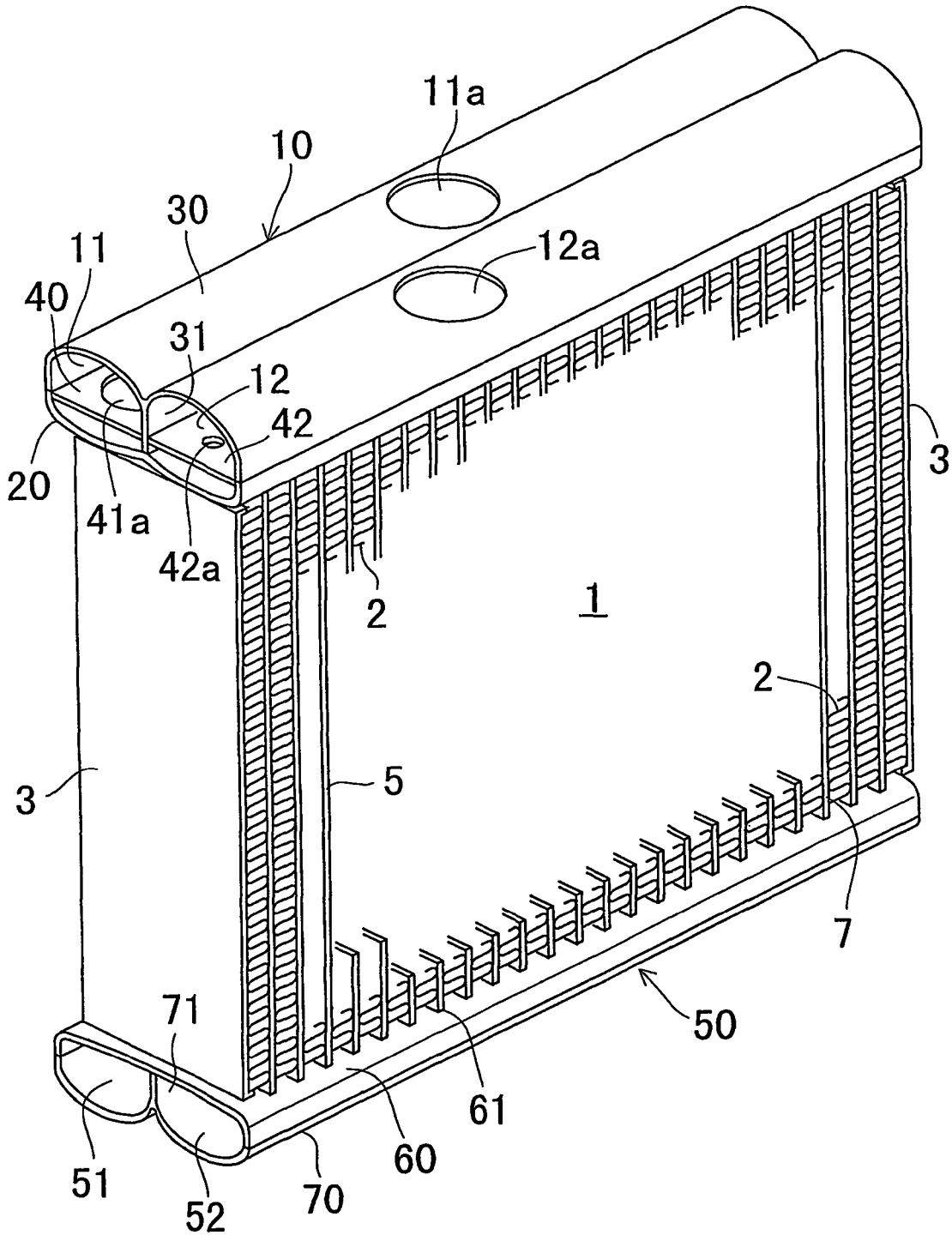
FIG. 2 is a perspective view showing the evaporator of the first embodiment.
Figure 3:
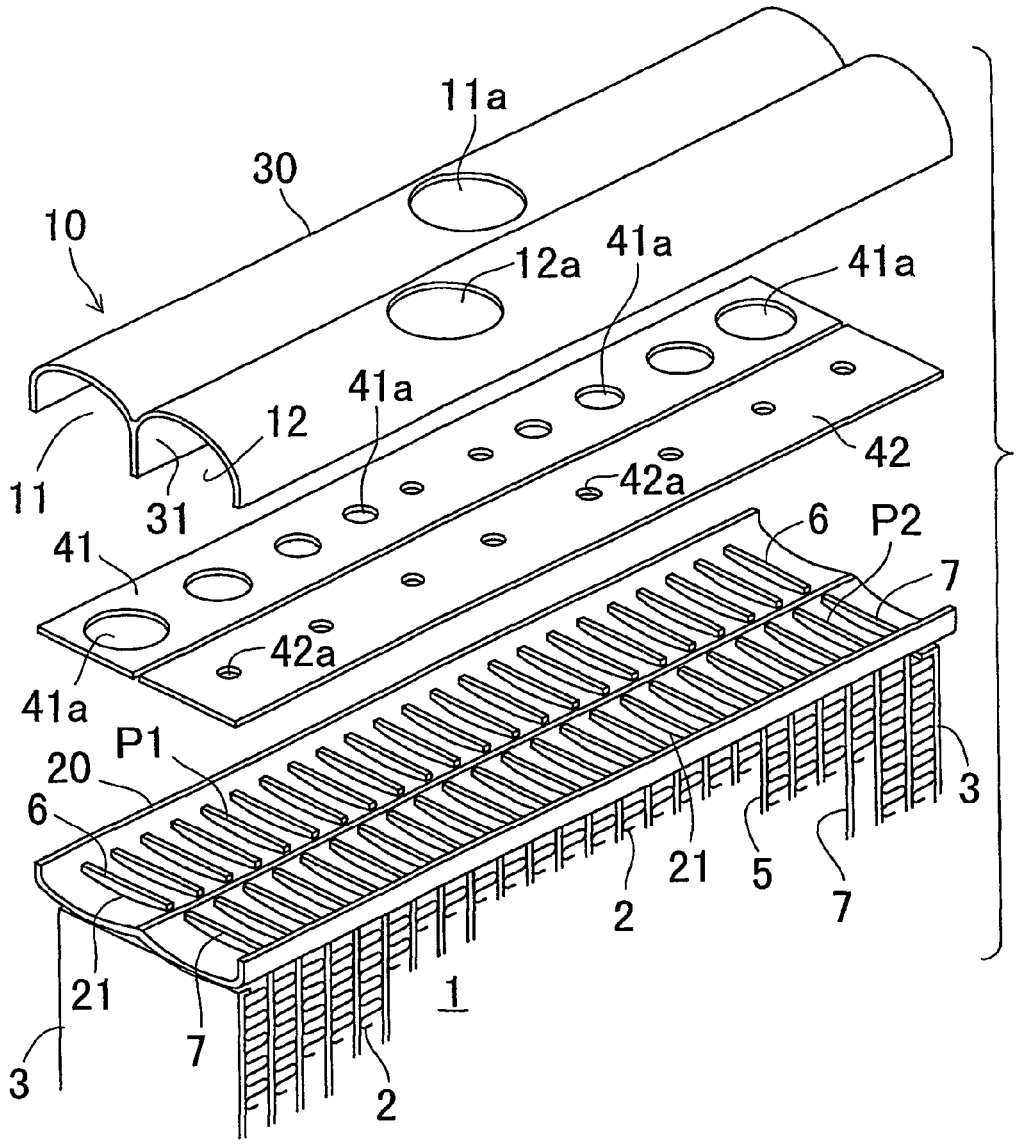
FIG. 3 is a perspective exploded view showing the upper portion of the evaporator of the first embodiment.

Furthermore, as shown in FIG. 1, a header cap 15 is attached to each of both end openings of the upper header member 10 so as to air-tightly seal each end opening.

Furthermore, to the refrigerant inlet 11*a* and the refrigerant outlet 12*a* of the upper header member 10, joint tubes 11*b* and 12*b* are fixed so as to communicate with the inlet 11*a* and outlet 12*a*.

In this embodiment, the refrigerant distributing resistance plate 41 and the uneven-distribution-flow preventing resistance plate 42 are formed separately to the header plate 20 and the header cover 30. In the present invention, however, these resistance plates 41 and 42 may be integrally formed with the header plate 20 and/or the header cover 30. Furthermore, the partitioning wall 31 may be integrally formed with the header plate 20. Alternatively, the partitioning wall 31 may be formed as a separate member.

To each of the tube mounting apertures 21 of the header plate 20 constituting the aforementioned upper header member 10, the upper end of each of the heat exchanging tubes 6 and 7 constituting the aforementioned core 1 is fixed in an inserted state. In this state, the upstream-side heat exchanging tubes 6 are communicated with the inlet-side tank 11, while the downstream-side heat exchanging tubes 7 are communicated with the outlet-side tank 12.

Figure 4:
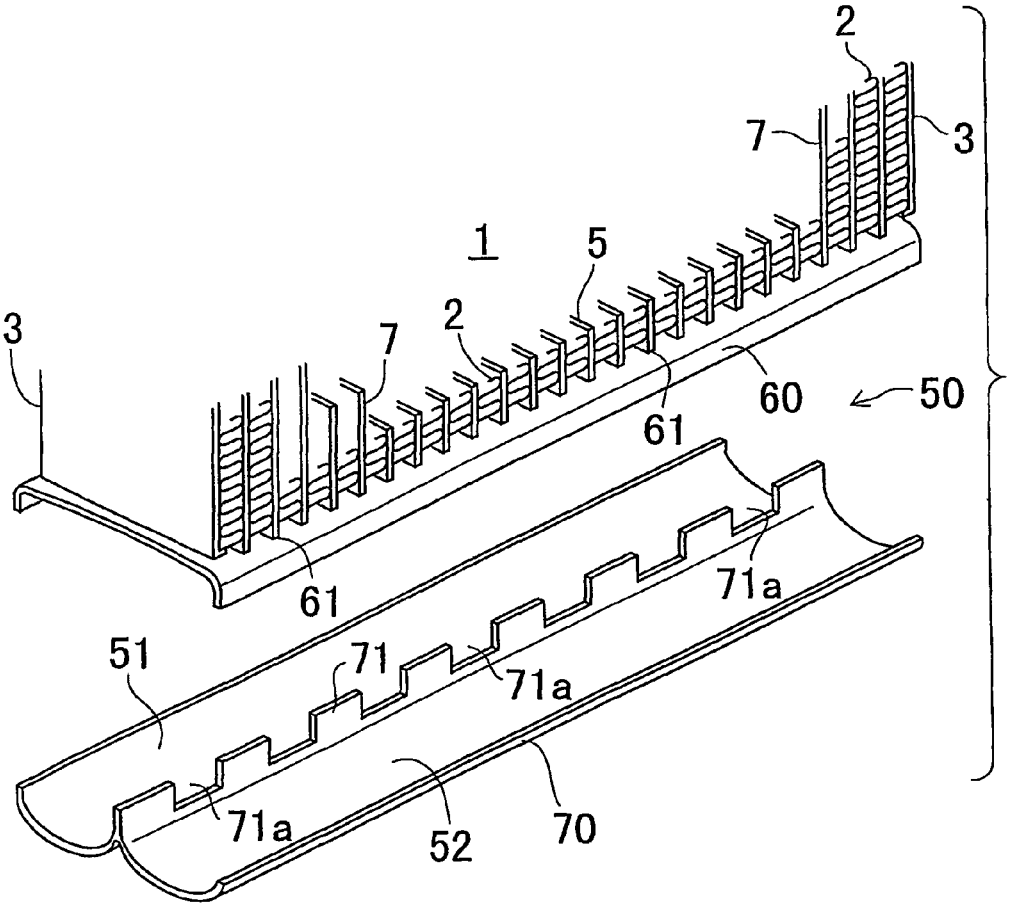
FIG. 4 is a perspective exploded view showing the lower portion of the evaporator of the first embodiment.
Figure 5:
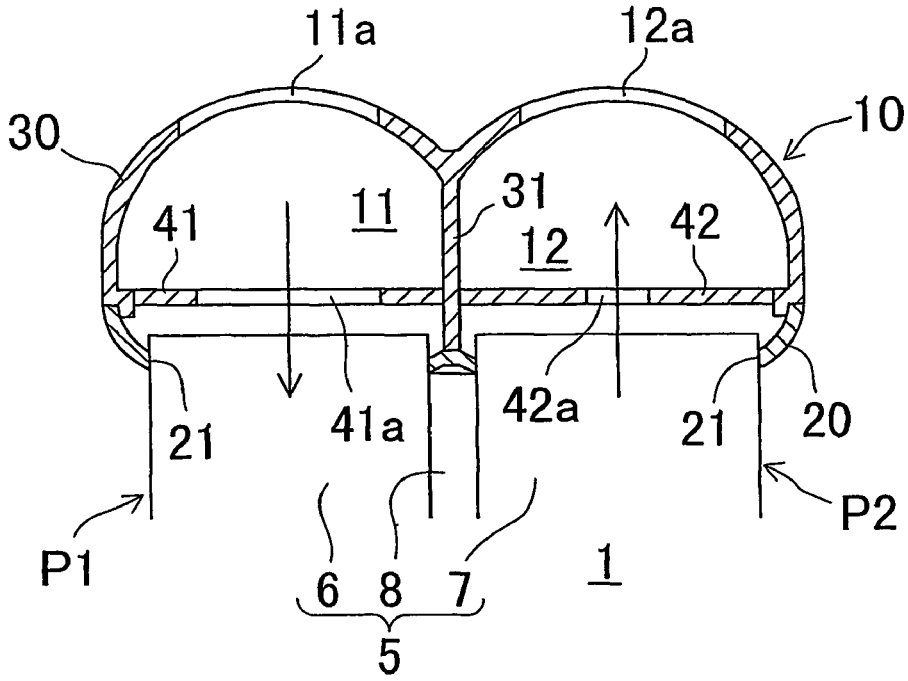
FIG. 5 is an enlarged side cross-sectional view showing the upper header member of the evaporator of the first embodiment.
Figure 6:
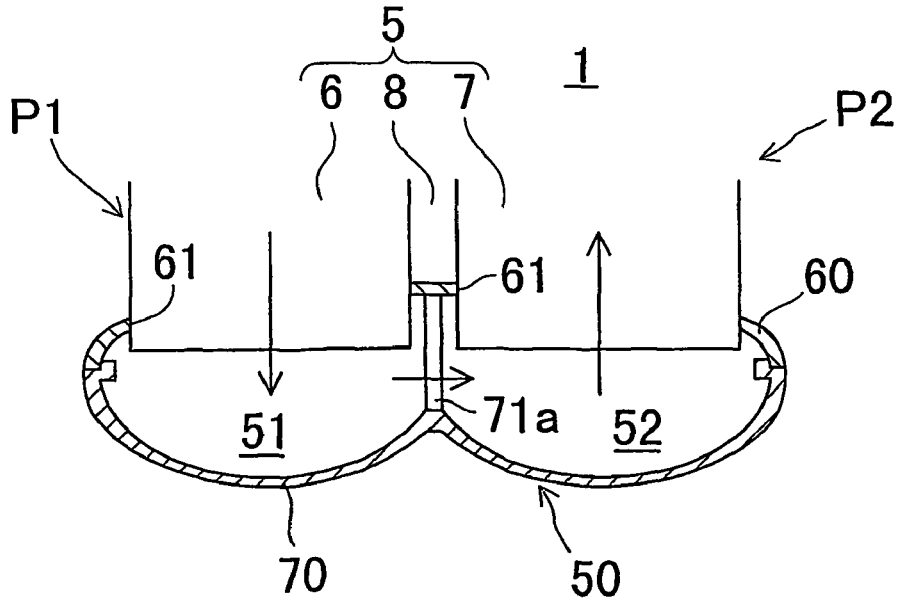
FIG. 6 is an enlarged side cross-sectional view showing the lower header member of the evaporator of the first embodiment.

On the other hand, as shown in FIGS. 4 and 6, the lower side header member 50 is disposed at the lower end portion of the core 1 along the core width direction, and has a header plate 60 and a header cover 70.

The header plate 60 is provided with a plurality of tube mounting apertures 61 arranged at certain intervals in the longitudinal direction thereof at the front half region and the rear half region thereof respectively.

The header cover 70 is attached to the header plate 60 so as to cover the lower surface of the header plate, and has, at the widthwise middle position on the upper surface thereof, a partitioning wall 71 continuously extending in the longitudinal direction of the header cover (the core width direction). This partitioning wall 71 is provided with a plurality of cut-out communication apertures 71*a* at certain intervals in the longitudinal direction.

By the space surrounded by the header plate 60 and the header cover 70 and positioned behind the partitioning wall 71, an inflow-side tank 51 having a tube shape and extending in the core width direction is formed. On the other hand, by the space surrounded by the header plate 60 and the header cover 70 and positioned in front of the partitioning wall 71, an outflow-side tank 52 having a tube shape and extending in the core width direction is formed. In this case, the inflow-side tank 51 and the outflow-side tank 52 are communicated by the cut-out communication apertures 71*a* formed in the partitioning wall 71.

Furthermore, as shown in FIG. 1, a header cap 55 is attached to each of the end openings of the lower header member 50 in an air-tightly sealed manner. In the present invention, the partitioning wall 71 of the lower header member 50 may be integrally formed with the header plate 60 or may be formed as a separate member.

To each of the tube mounting apertures 51 of the header plate 60 of the aforementioned lower header member 50, the lower end of each heat exchanging tube 6 and 7 is fixed in an inserted manner. In this state, the upstream-side heat exchanging tube 6 is communicated with the inflow-side tank 51 of the lower header member 50, while the downstream-side heat exchanging tube 7 is communicated with the outflow-side tank 52.

In the evaporator of the first embodiment constituted as mentioned above, each component is made of aluminum or its alloy, or an aluminum brazing sheet in which a brazing layer is laminated on at least one surface of the brazing sheet. These components are provisionally assembled together with brazing materials if necessary into a predetermined evaporator configuration. Then, this provisionally assembled product is collectively brazed in a furnace to integrally connect the components.

In this invention, however, the method of connecting the components is not specifically limited and may be performed by any known procedure.

The aforementioned evaporator is mounted as an automobile refrigeration cycle together with a compressor, a condenser and decompressing means such that the front-face side (the downstream-side heat exchanging tube group side P2) and the rear-face side (the upstream-side heat exchanging tube side P1) constitute an air taking-in side and an air taking-out side, respectively.

Then, the mist-like two phase refrigerant including a liquid phase and a vapor phase passed the compressor, the condenser and the decompressing means is introduced into the inlet-side tank 11 of the upper header member 10 via the refrigerant inlet 11*a* of the aforementioned evaporator.

The refrigerant introduced into the inlet-side tank 11 is distributed by the refrigerant distributing resistance plate 41 in the longitudinal direction of the tank 11 and passes through each refrigerant passage aperture 41*a* of the resistance plate 41. At this time, the refrigerant tends to pass through the refrigerant passage apertures 41*a* near the refrigerant inlet 11*a*, i.e., the refrigerant passage apertures 41*a* located at the longitudinal middle portion, at a large rate because of the inertia. However, in this embodiment, since the flow velocity of the refrigerant decreases by the resistance plate 41, the refrigerant distributes smoothly in the longitudinal direction and passes through each refrigerant passage aperture 41*a*. Furthermore, in this embodiment, the refrigerant passage aperture 41*a* of the resistance plate 41 is formed to be small in diameter at the longitudinal middle portion, while the refrigerant passage aperture 41*a* is formed to be larger as it goes toward the end portion of the resistance plate 41. Therefore, the volume of refrigerant passing through each refrigerant passage aperture 41*a* is restricted moderately, and therefore the refrigerant equally passes through each refrigerant passage aperture 41*a*. This also enables to effectively distribute the refrigerant in the longitudinal direction of the inlet-side tank 10.

The refrigerant equally distributed by the resistance plate 41 is equally introduced into each tube 6 of the upstream-side heat exchanging tube group P1.

The refrigerant introduced into the upstream-side heat exchanging tube group P1 is introduced into the inflow-side tank 51 of the lower header member 50 through each tube 6, and then introduced into the outflow-side tank 52 through the cut-out communication apertures 71*a* of the partitioning wall 71.

Since the refrigerant passing through the upstream-side heat exchanging tube group P1 is equally distributed into each heat exchanging tube 6, the refrigerant is equally distributed and introduced into each tube 7 of the downstream-side heat exchanging tube group P2 by passing through the inflow-side tank 51 and the outflow-side tank 52*s* of the lower header member 50 while keeping the equally distribution state.

The refrigerant passed through each downstream-side heat exchanging tube 7 is introduced into the outlet-side tank 12 of the upper header member 10. In the outlet-side tank 12, the refrigerant receives a moderate flow resistance by the uneven-distribution-flow preventing resistance plate 42, resulting in an equally balanced pressure of refrigerant at the entire longitudinal direction of the outlet-side tank 12, which assuredly prevents uneven-distribution-flow of the refrigerant. Thus, the refrigerant flows out of the refrigerant outlet 12*a* via each refrigerant passage aperture 42*a* of the resistance plate 42.

Since the uneven-distribution-flow preventing resistance plate 42 prevents the refrigerant from being unevenly distributed in the outlet-side tank 12, the refrigerant is effectively prevented from being unevenly distributed in the downstream-side heat exchanging tube group P2. Thus, the refrigerant can pass through each heat exchanging tube 7 at the downstream-side in an evenly distributed manner.

The refrigerant flowed out of the refrigerant outlet 12*a* of the upper header member 10 is returned to the compressor in the aforementioned refrigeration cycle.

The refrigerant passing through the upstream and downstream-side heat exchanging tube groups P1 and P2 absorbs heat from the air A taken from the front-side of the core 1 and evaporates by exchanging heat with the air. Furthermore, the air A cooled by the heat absorption flows out of the rear-side of the core 1, and is sent to the interior of a car.

As mentioned above, according to the evaporator of this embodiment, the refrigerant passes through each heat exchanging tube 6 and 7 of the upstream-side and downstream-side heat exchanging tube groups P1 and P2 in an equally distributed manner. Therefore, the refrigerant can exchange heat at the entire region of the heat exchanging tube groups P1 and P2, i.e., the entire region of the core 1, resulting in an improved heat exchange performance.

Furthermore, in this embodiment, since the refrigerant passes through two tube groups P1 and P2 forming a simple U-shaped refrigerant passage, the refrigerant flow resistance can be decreased. As a result, the passage cross-sectional area of the refrigerant can be decreased, and therefore the tube height of each heat exchanging tube 6 and 7 can be decreased. Accordingly, the size, weight and thickness can be further decreased. Furthermore, by decreasing the tube height, the installation number of heat exchanging tubes 6 and 7 can be increased without changing the evaporator size, resulting in further enhanced refrigeration dispersibility, which in turn can further improve the heat exchange performance.

Furthermore, in the present embodiment, the partitioning wall 31 disposed between the upper wall and the bottom wall of the upper header member 10 continuously extends within the upper header member 10 in the longitudinal direction, and the partitioning wall 71 disposed between the upper wall and the bottom wall of the lower header member 50 continuously extends within the lower header member 50 in the longitudinal direction. Accordingly, these partitioning walls 31 and 71 reinforce each header member 10 and 50, and therefore both the header members 10 and 50 can be improved in pressure resistance.

Furthermore, in this embodiment, a tubular member 5 which is formed by integrally connecting the corresponding heat exchanging tubes 6 and 7 of the upstream-side heat exchanging tube group P1 and the downstream-side heat exchanging tube group P2 is employed. Therefore, the upstream-side and downstream-side heat exchanging tubes 6 and 7 can be formed by simply laminating the aforementioned tubular members 5. As a result, the evaporator can be fabricated easily. Furthermore, since the heat exchanging tubes 6 and 7 are connected between the heat exchanging tube groups P1 and P2, the strength of the assembly is increased.

Figure 10:
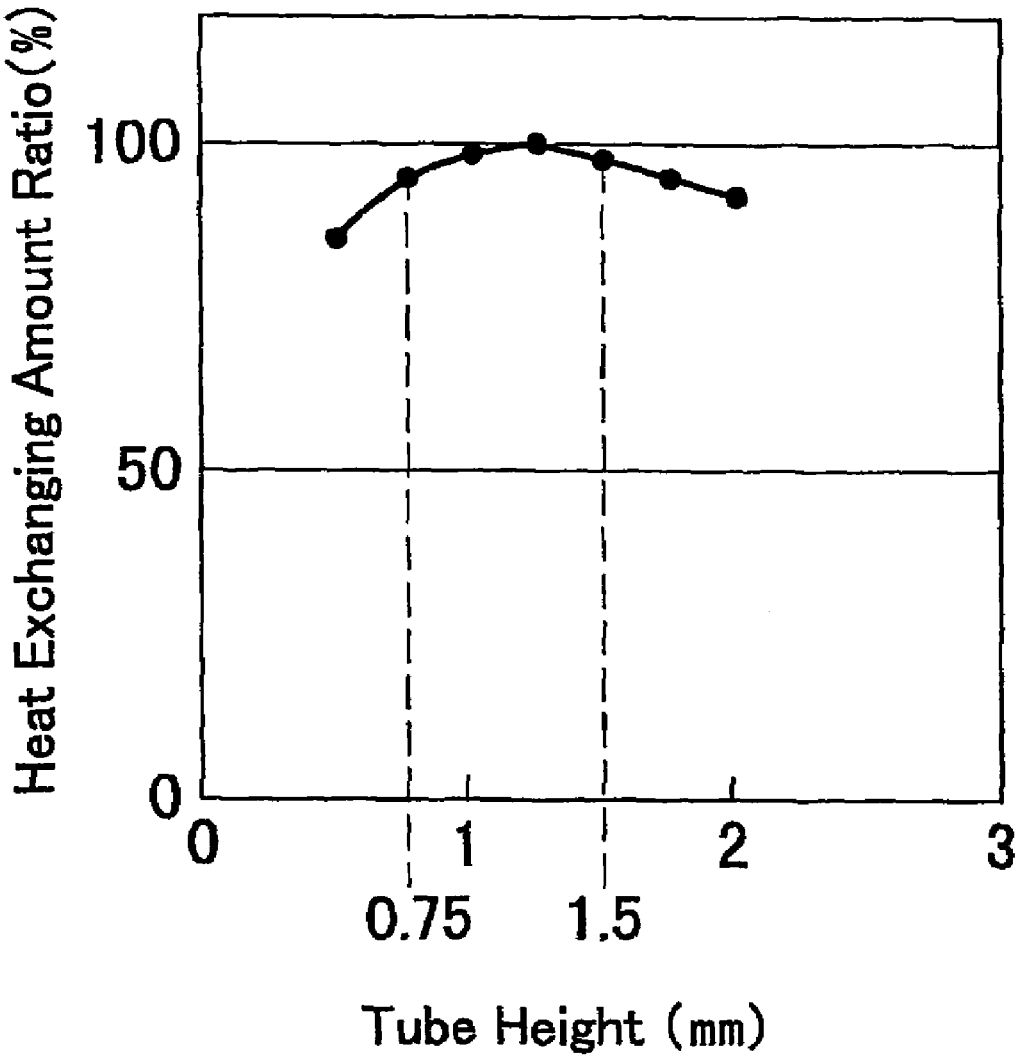
FIG. 10 is a graph showing the relation between a tube height and a heat exchange amount ratio in the evaporator of the first embodiment.

Now, in the evaporator according to this embodiment, the relation of the tube height H of the heat exchanging tube and the heat exchanging amount ratio % is shown in FIG. 10. As apparent from this graph, according to the evaporator of the present invention, the heat exchanging amount ratio is high at the tube height H falling within the range of 0.75 to 1.5 mm. Therefore, a heat exchanging tube of such a tube height is suitably employed.

By the way, in a conventional heat exchanging tube used for the so-called header type heat exchanger, it is considered that the tube height preferably falls within the range of about 1.5 to 3.0 mm which is twice the height of the tube height of the evaporator according to this embodiment.

Figure 11:
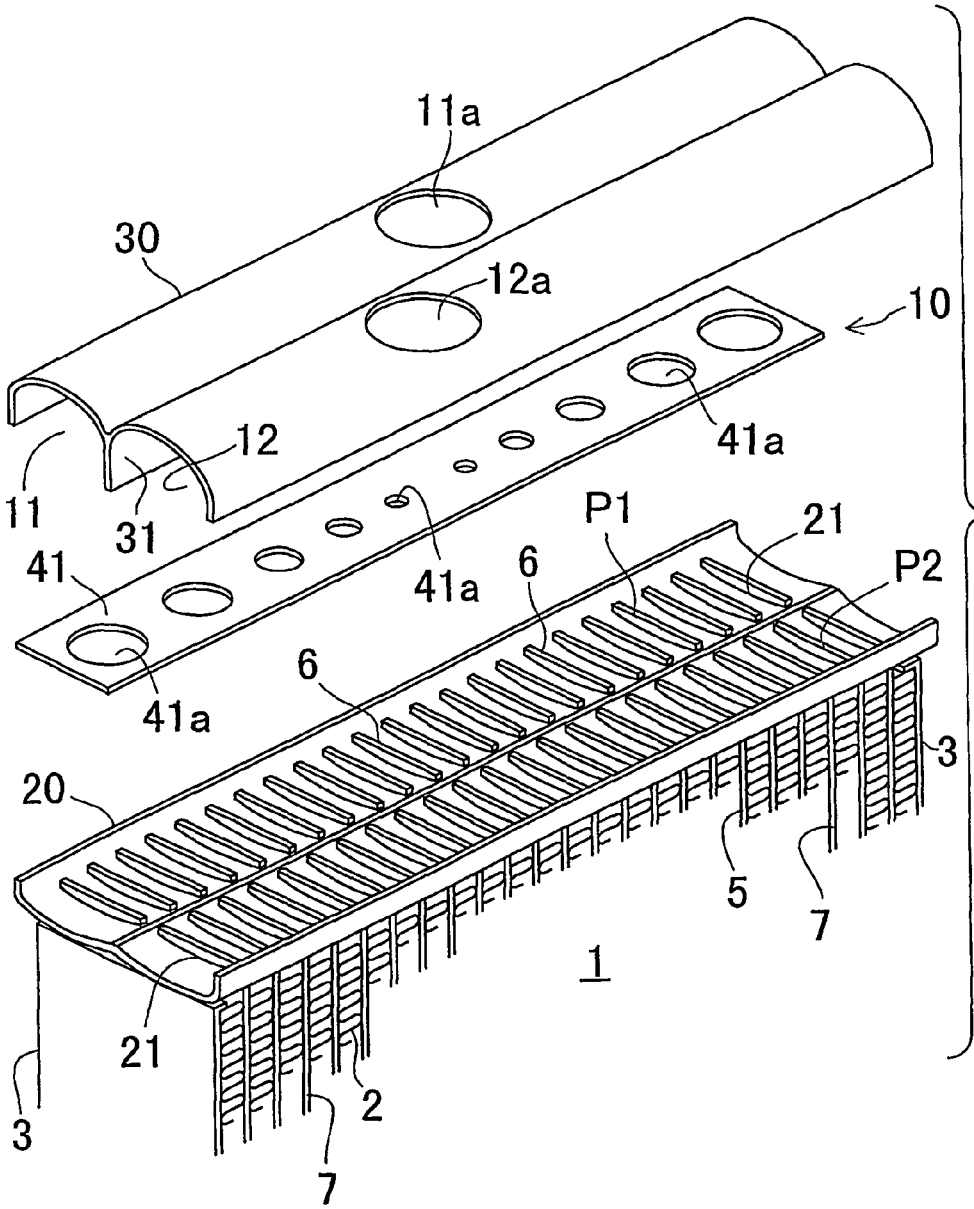
FIG. 11 is an exploded perspective view showing the upper portion of the evaporator which is a first modification of the present invention.
Figure 12:
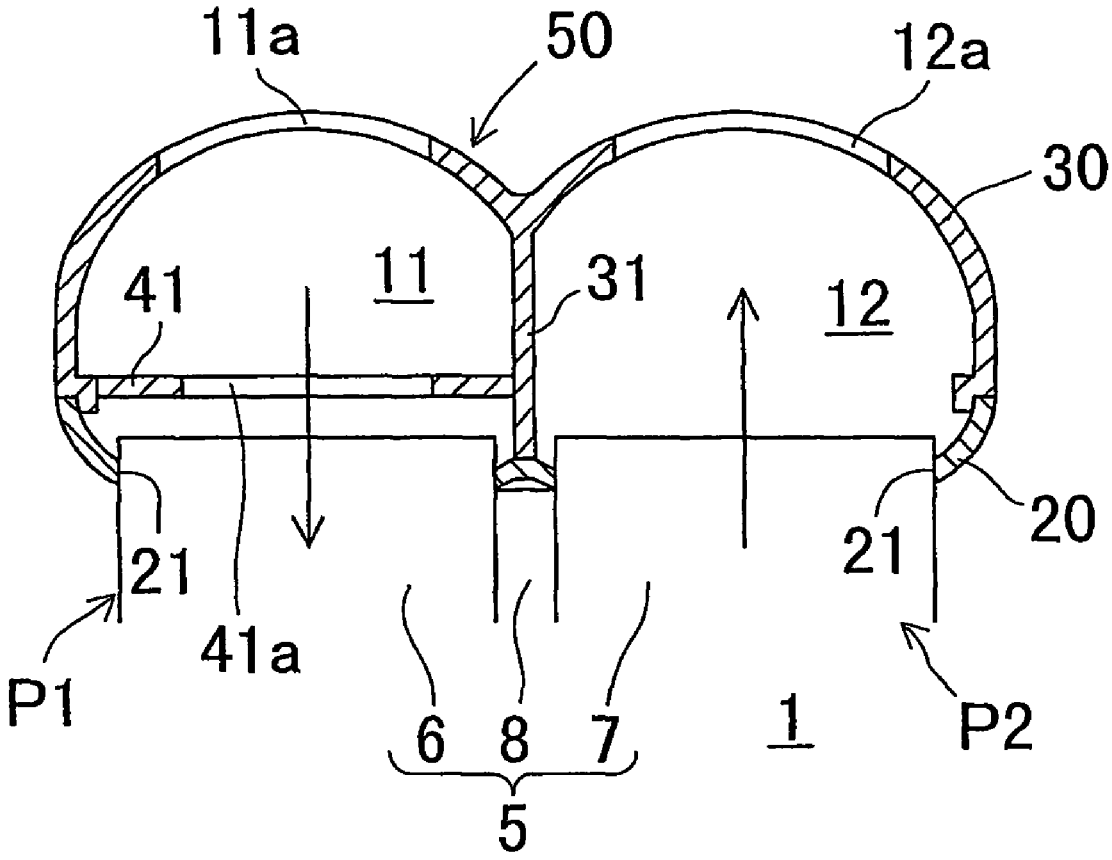
FIG. 12 is an enlarged side cross-sectional view showing the upper header member of the evaporator of the first modification.
Figure 13:
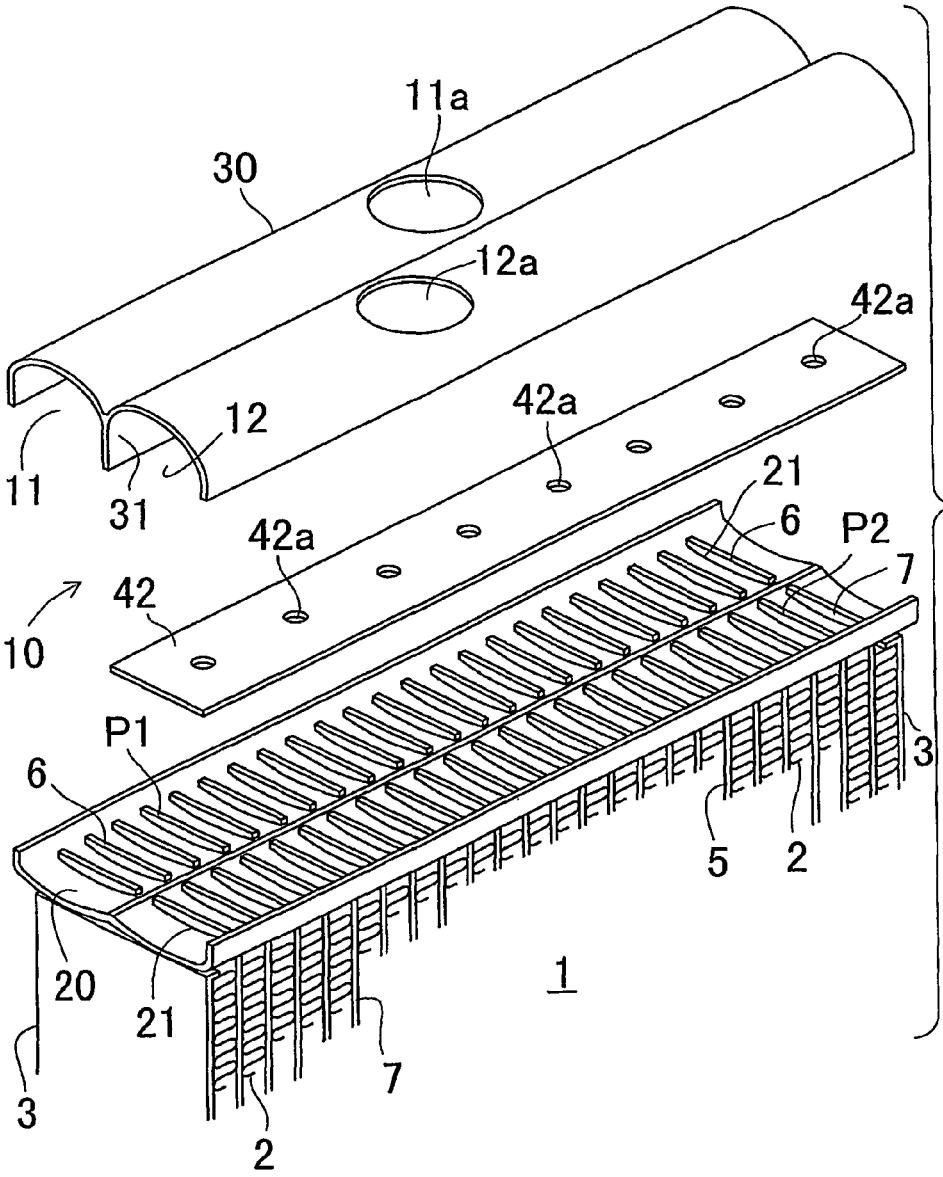
FIG. 13 is an exploded perspective view showing the upper portion of the evaporator which is a second modification of the present invention.
Figure 14:
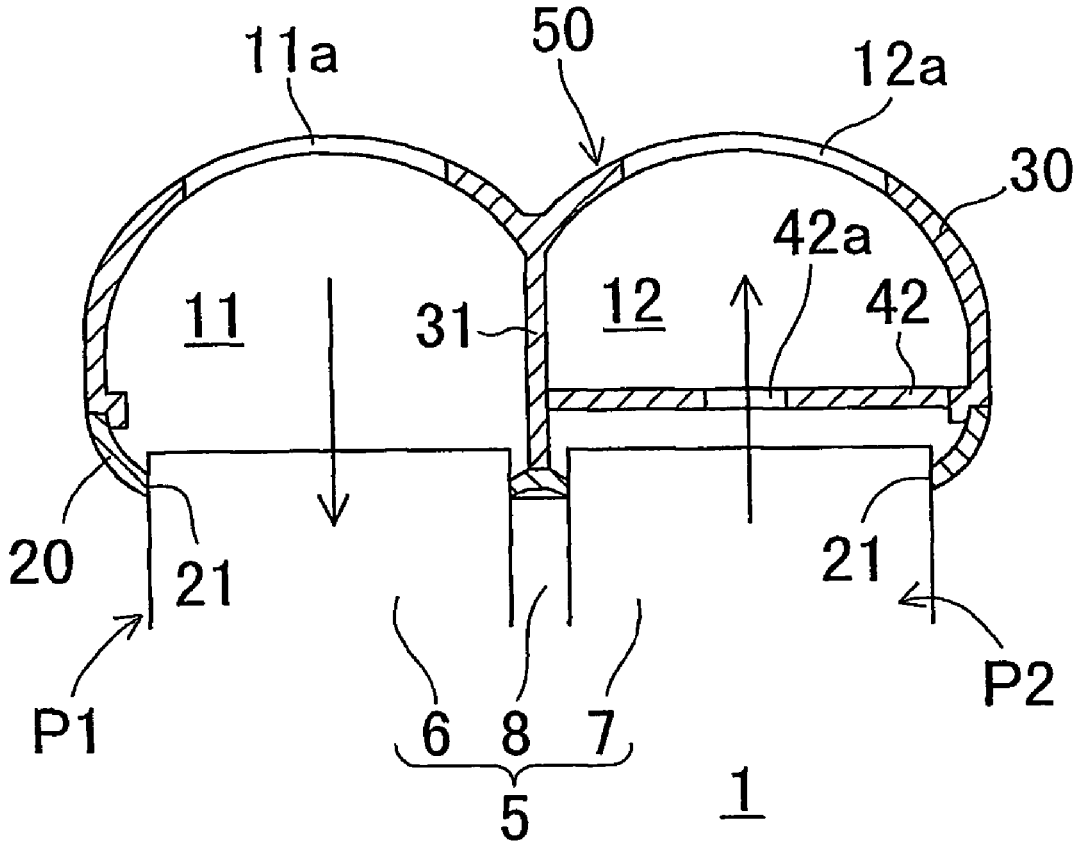
FIG. 14 is an enlarged cross-sectional view showing the upper header member of the evaporator which is the second modification.

Furthermore, in the aforementioned embodiment, although the refrigerant distributing resistance plate 41 and the uneven-distribution-flow preventing resistance plate 42 are provided in the inlet-side tank 11 and the outlet-side tank 12 of the upper header member 10, the present invention is not limited to it. For example, as shown in FIGS. 11 and 12, the uneven-distribution-flow preventing resistance plate 42 may be omitted. Alternatively, as shown in FIGS. 13 and 14, the refrigerant distributing resistance plate 41 may be omitted, or both of the refrigerant distributing resistance plate 41 and the uneven-distribution-flow preventing resistance plate 42 may be omitted.

Figure 15B:
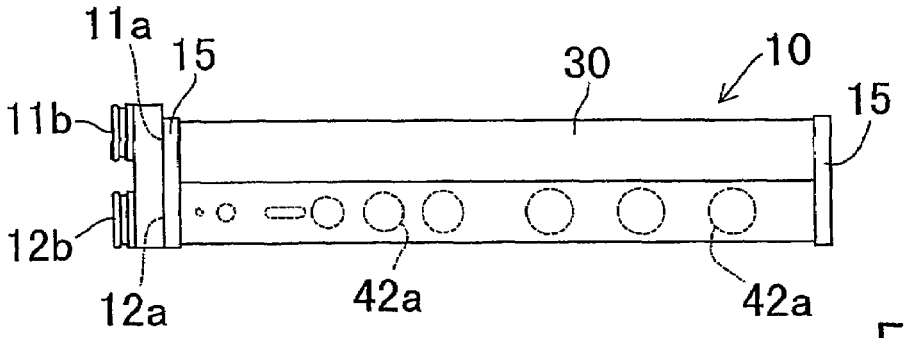
FIG. 15B is a top view showing the evaporator which is the third modification.
Figure 15A:
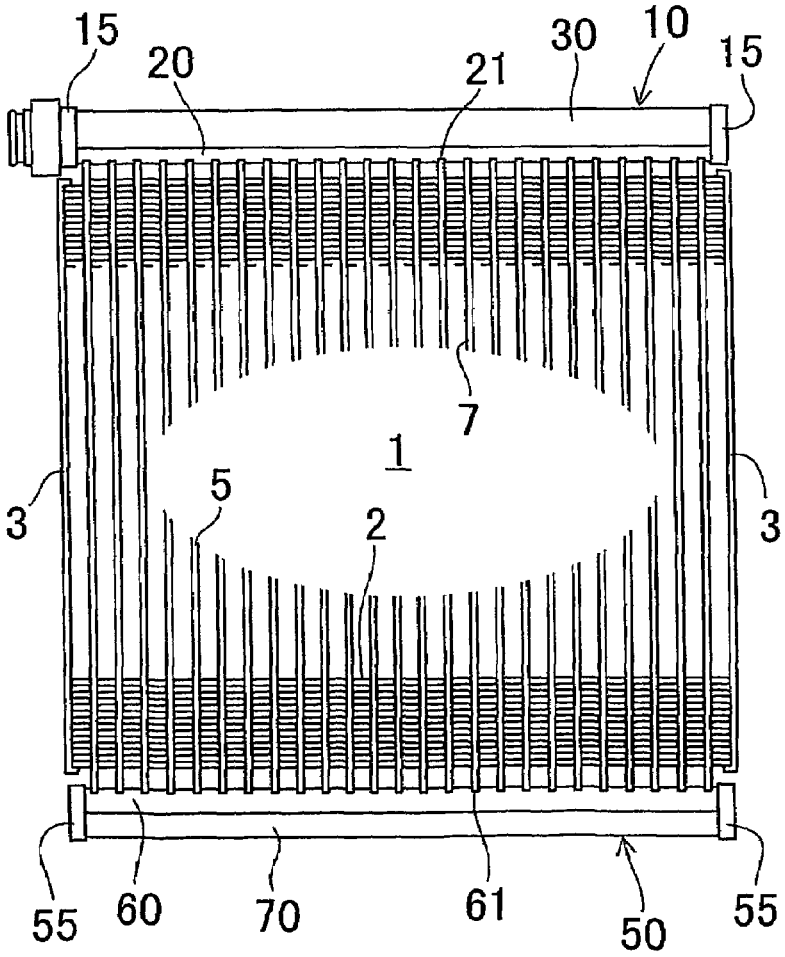
FIG. 15A is a front view showing the evaporator which is the third modification.

Furthermore, in the aforementioned embodiment, although the refrigerant inlet 11*a* and outlet 12*a* are formed in the longitudinal middle upper portion of the upper header member 10, the present invention is not limited to it. For example, as shown in FIG. 15, refrigerant inlets 11*a* and 12*a* may be formed at one end portion of the header member 10 so that the refrigerant can be flowed into and out of the evaporator from the header end portion.

Figure 16:
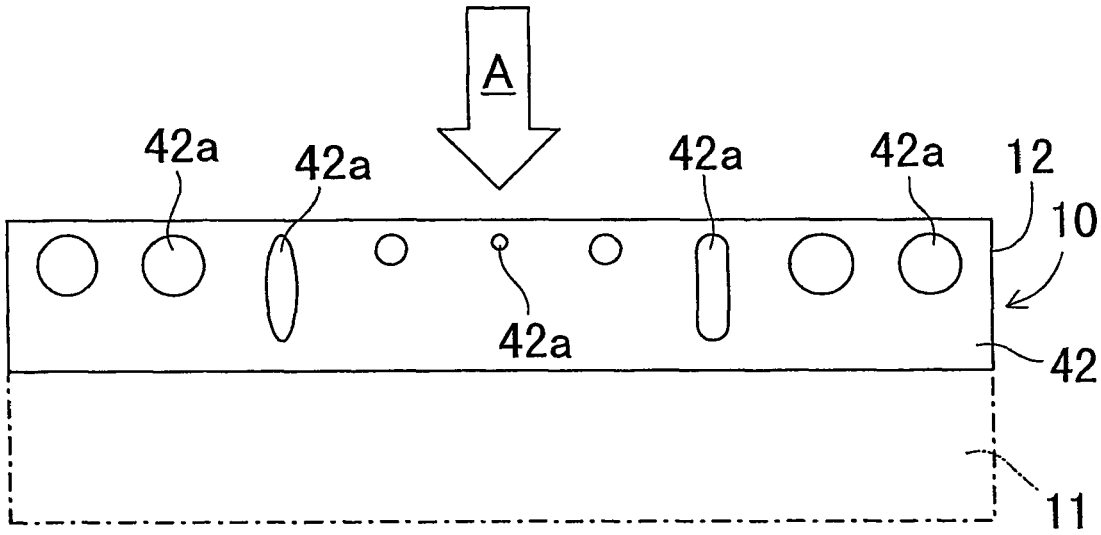
FIG. 16 is a plane view showing the uneven-distribution-f low preventing resistance plate of the evaporator which is a fourth modification.

Furthermore, in the aforementioned embodiment, as shown in FIG. 16, the refrigerant passage apertures 42*a* of the uneven-distribution-flow preventing resistance plate 42 may be formed at the windward side of the widthwise middle portion of the tube relative to the air taking-in direction of the evaporator. Furthermore, the refrigerant passage aperture 42*a* may be formed into a circular shape, or an ellipse shape or a rectangle shape having a major axis along the widthwise direction of the heat exchanging tube.

Figure 17:
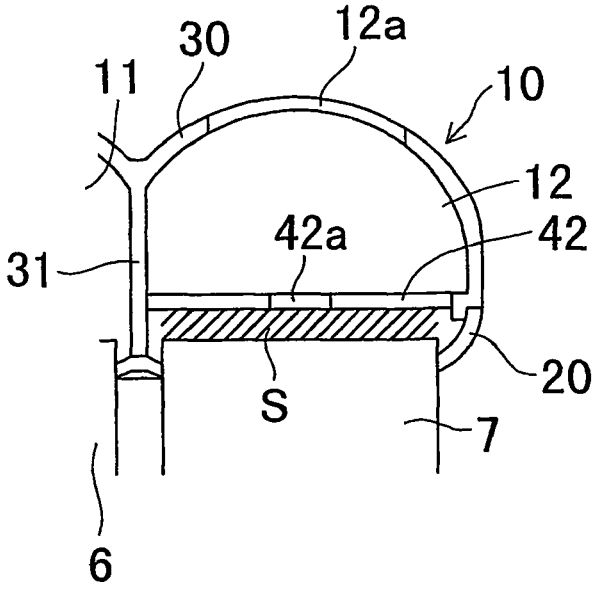
FIG. 17 is a side cross-sectional view showing the outlet-side-tank of the upper header member in the evaporator of the first embodiment.

Furthermore, in the aforementioned embodiment, as shown in FIG. 17, it is preferable that the cross-sectional area S of the gap (shown by hatching in FIG. 17) formed between the resistance plate 42 and the end portion of the heat exchanging tube 7 in the outflow-side tank 12 of the upper side header member 10 is 1 to 5 times of the passage cross-sectional area of the heat exchanging tube 7. In cases where this structure is adopted, it is possible to prevent an increase of the flow resistance between the uneven-distribution-flow preventing resistance plate 42 and the tube end portion and secure an appropriate space in the header member.

Furthermore, in the evaporator of the aforementioned embodiment, although an air A is introduced from the downstream-side heat exchanging tube group P2 as an evaporator front side, the present invention is not limited to it. In the present invention, an air A may be introduced from the upstream-side heat exchanging tube group P1 as an evaporator front side.

Furthermore, in this embodiment, the installation direction of the evaporator is not limited to a specific direction, and the evaporator may be installed at any direction.

Second Embodiment

Figure 18:
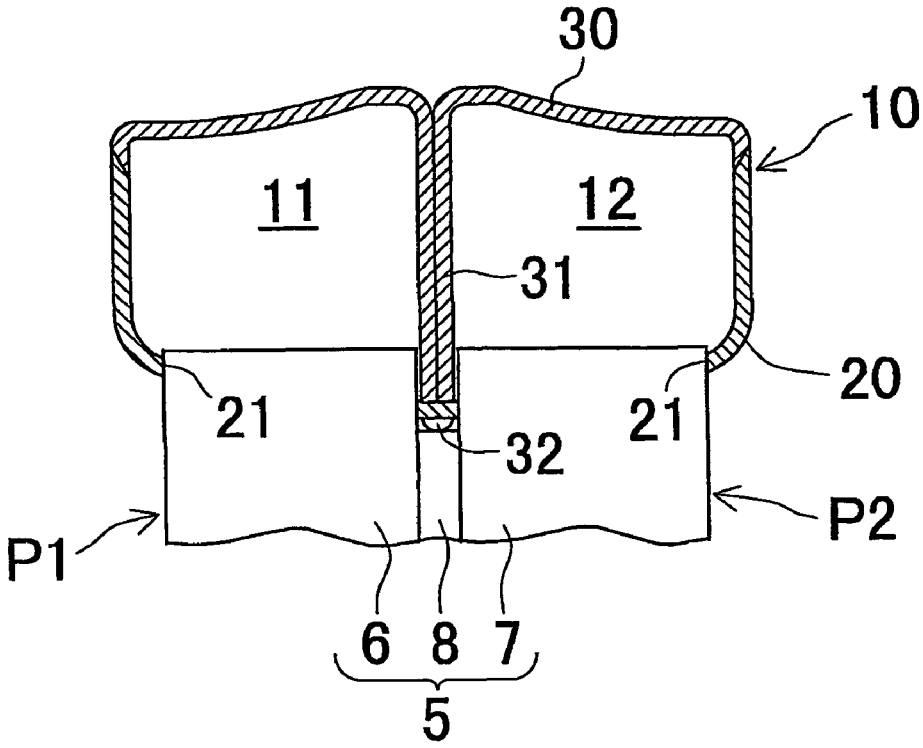
FIG. 18 is an enlarged side cross-sectional view showing the upper header member of the evaporator which is the second embodiment of the present invention.
Figure 19:
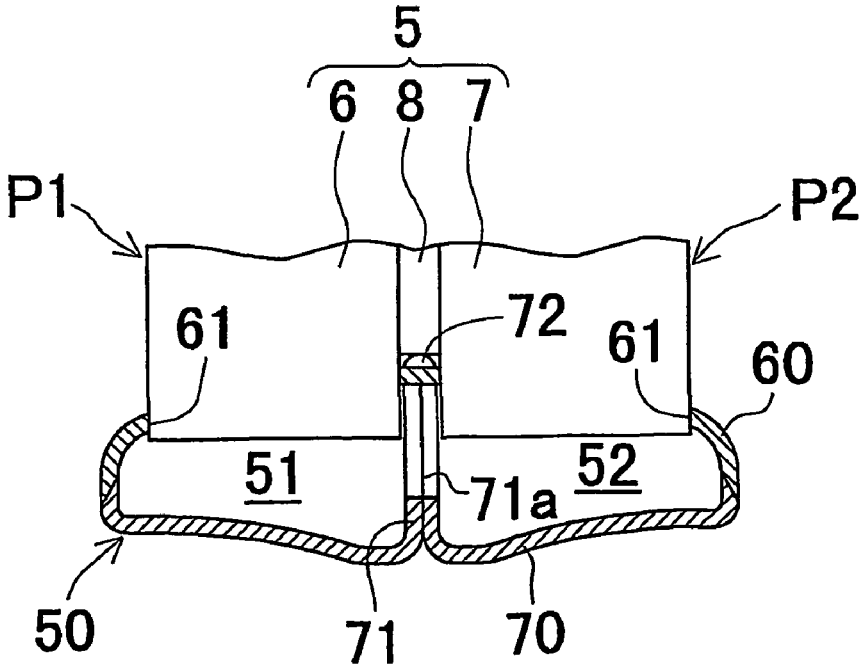
FIG. 19 is an enlarged side cross-sectional view showing the lower header portion member of the evaporator which is the second embodiment.

FIGS. 18 and 19 show an evaporator of a second embodiment of the present invention. As shown in these figures, in the evaporator of this embodiment, the header plate 20 and 60 and the header cover 30 and 70 constituting the inlet-and-outlet side (upper side) header member 10 and the refrigerant-turn-side (lower side) header member 50 are formed by a press-formed aluminum (or its alloy) plate respectively.

Figure 20A:
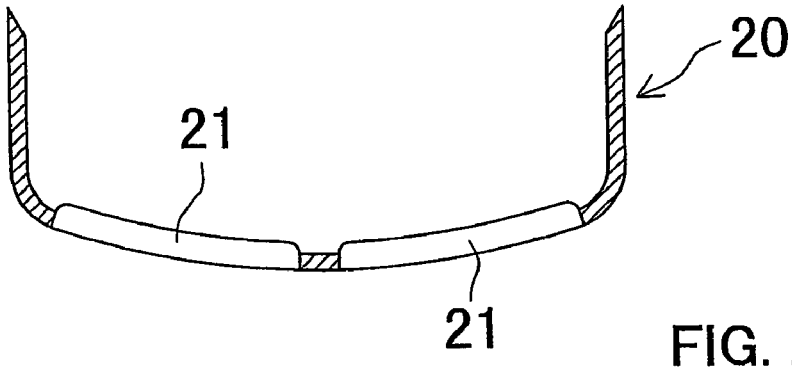
FIG. 20A is a side cross-sectional view showing a header plate in the upper header member of the second embodiment.
Figure 20B:
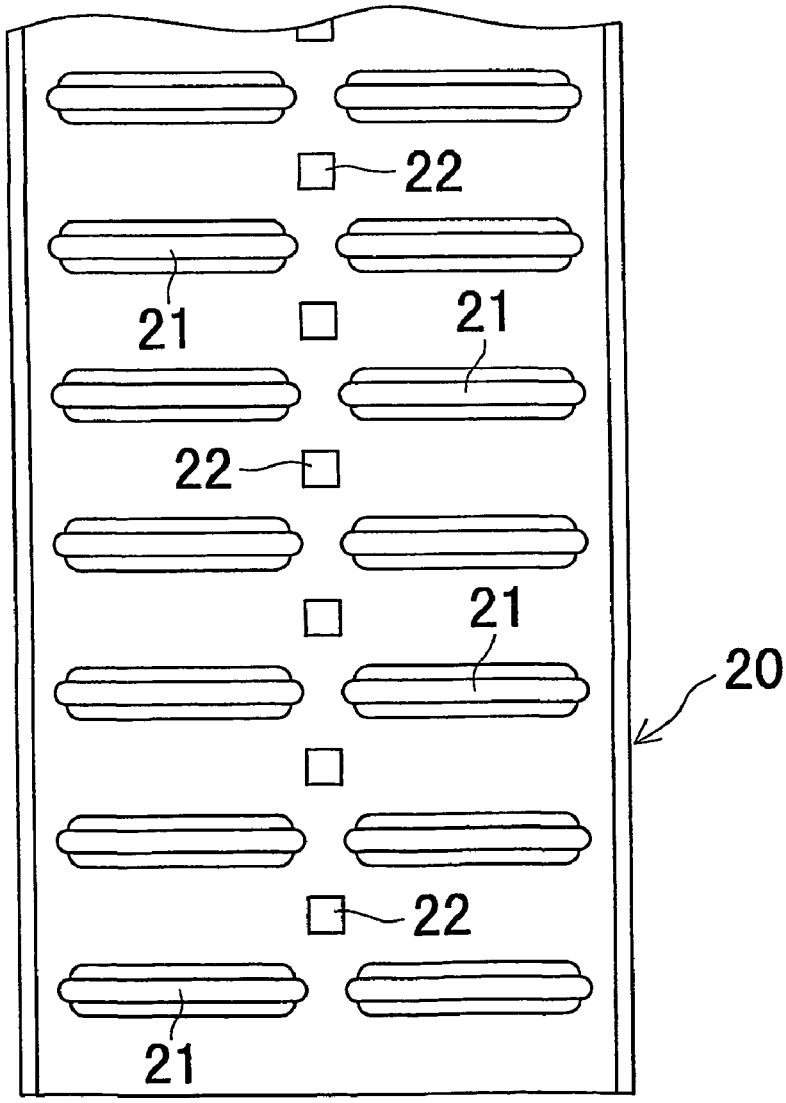
FIG. 20B is a plane view showing the header plate of the upper-header member according to the second embodiment.

That is, as shown in FIGS. 18 to 20, the header plate of the upper side header member 10 and 20 is formed by bending an aluminum plate to which perforation press forming is performed. By this press forming, a plurality of tube mounting apertures 21 are formed in the header plate 20 in two rows front and rear at certain intervals along the longitudinal direction and a plurality of engaging apertures 22 are formed at certain intervals along the longitudinal direction between the front and rear rows of the tube mounting apertures 21.

Figure 21A:
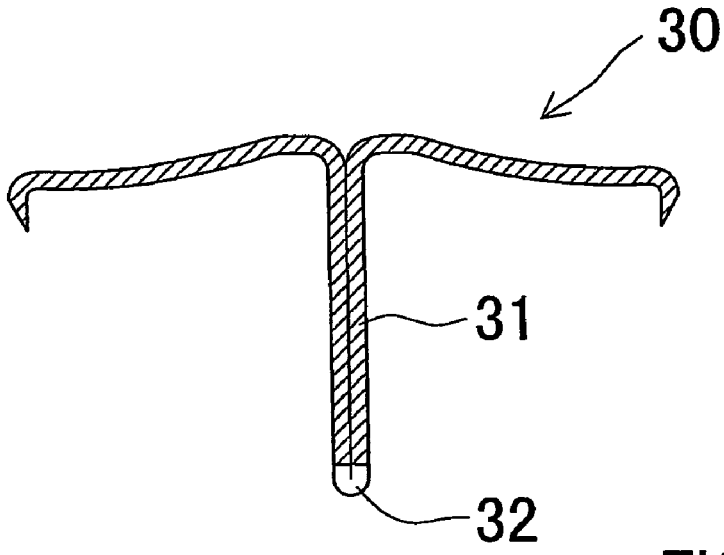
FIG. 21A is a side cross-sectional view showing the header cover of the upper header member of the second embodiment.
Figure 21B:
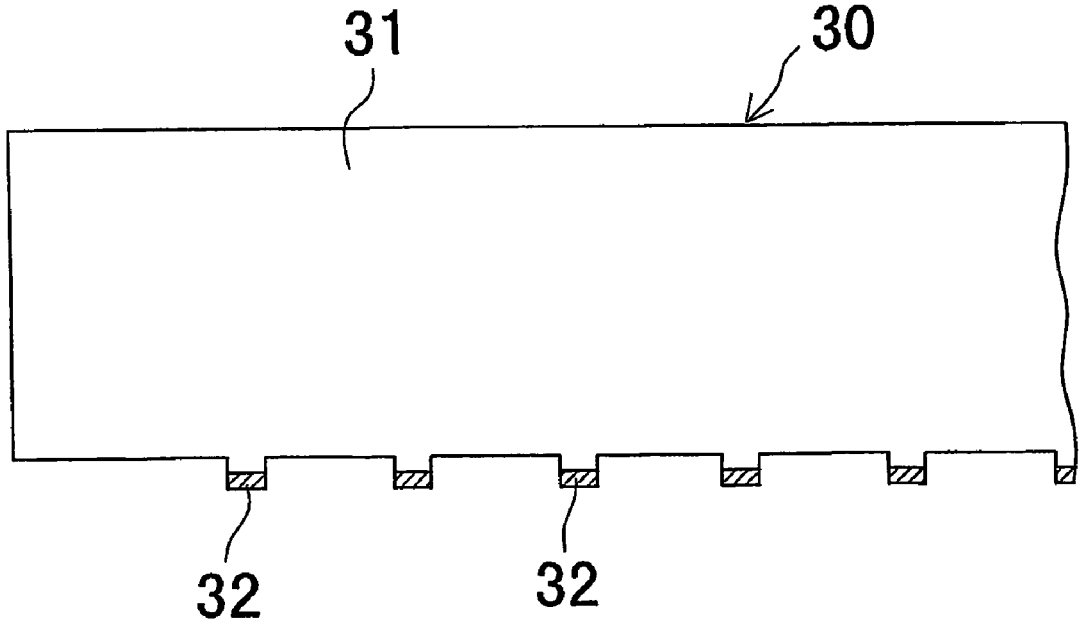
FIG. 21B is a front cross-sectional view showing the header cover of the upper header member of the second embodiment.

As shown in FIG. 21, the upper header cover 30 is made of an aluminum plate member which is thinner than a plate member constituting the aforementioned header plate 20, and is formed by subjecting the aluminum plate member to bending processing after the prescribed perforation processing. This press forming forms the header cover 30 such that a downwardly protruded partitioning wall 31 formed by folding the widthwise middle portion is formed and downwardly protruded engaging protrusions 32 corresponding to the aforementioned engaging apertures 22 of the header plate 20 are formed at the tip of each partitioning wall 31.

This header cover 30 is fixed to the header plate 20 in a state that the header cover 30 covers the upper surface side of the header plate 20 and the tip of the engaging protrusion 32 of the partitioning wall 31 is inserted in the engaging aperture 22 of the header plate 20 and caulked.

In this state, at the front-side space of the partitioning wall 31 surrounded by the header plate 20 and the header cover 30, an outlet-side tank 12 of a tube shape extending in the core width direction is formed, while at the rear-side space of the partitioning wall 31 an inlet-side tank 11 of a tube shape extending in the core width direction is formed.

Figure 22A:
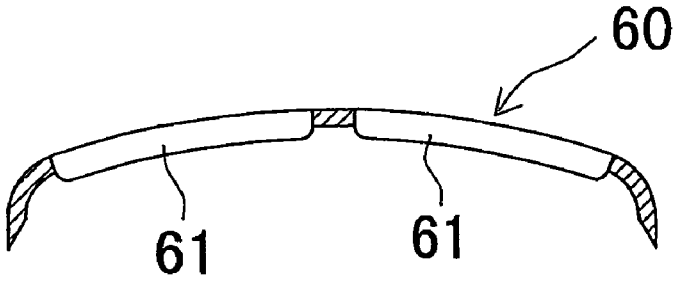
FIG. 22A is a side cross-sectional view showing the header plate of the lower header member of the second embodiment.
Figure 22B:
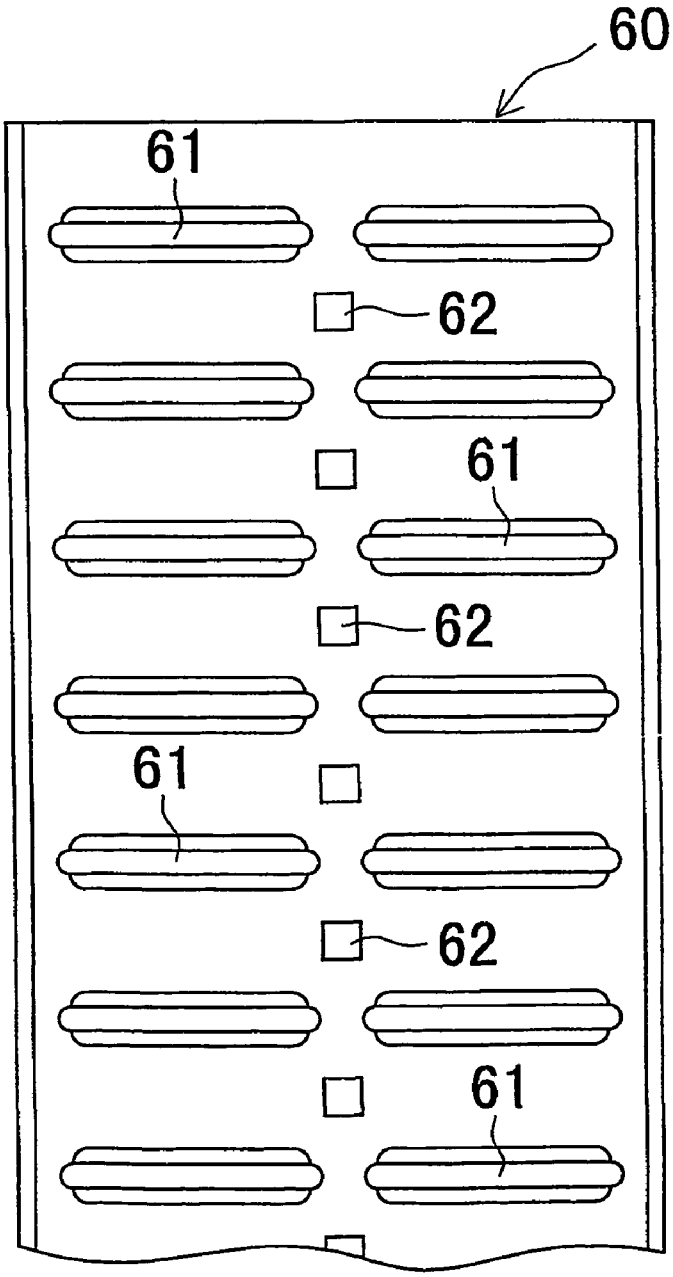
FIG. 22B is a plane view showing the header plate of the lower header member of the second embodiment.

As shown in FIG. 22, the lower side header plate 60 of the lower header member 60 is formed by subjecting an aluminum plate to a perforation processing and bending processing in the same manner as in the aforementioned header plate 10. By this press forming, a plurality of tube mounting apertures 61 are formed in the header plate 60 in two rows front and rear at certain intervals along the longitudinal direction and a plurality of engaging apertures 62 are formed at certain intervals along the longitudinal direction between the front and rear rows of the tube mounting apertures 61.

Figure 23A:
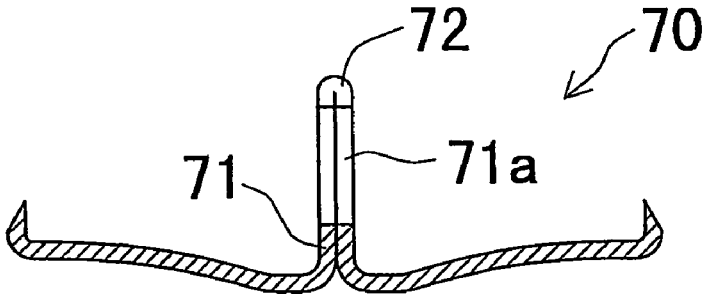
FIG. 23A is a side cross-sectional view showing the header cover of the lower header member of the second embodiment.
Figure 23B:
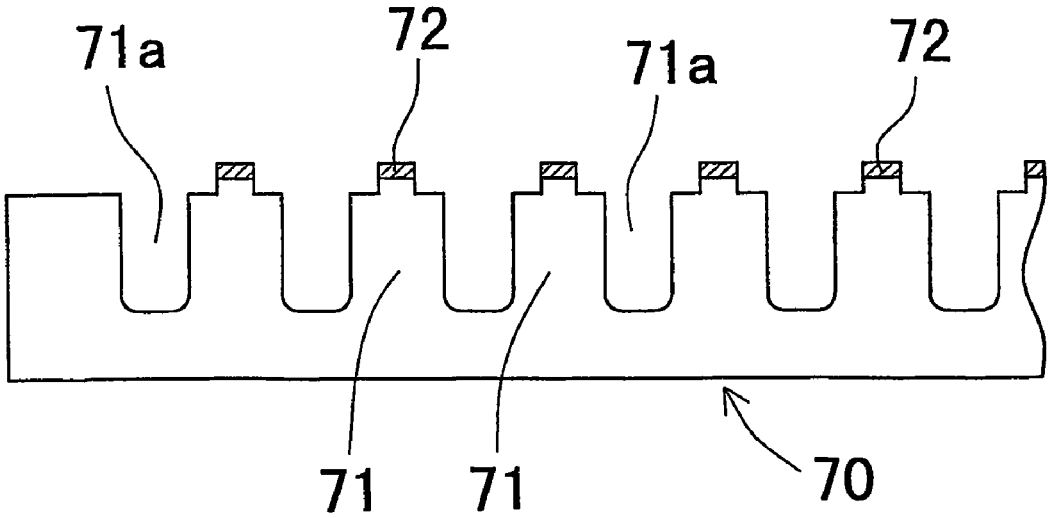
FIG. 23B is a plane view showing the header cover of the lower header member of the second embodiment.

As shown in FIG. 23, the lower header cover 70 is made of a thin aluminum plate member formed by subjecting the aluminum plate member to perforation processing and bending processing in the same manner as in the header cover 30. This press forming forms the header cover 70 such that an upwardly protruded partitioning wall 71 formed by folding the widthwise middle portion is formed and upwardly protruded engaging protrusions 72 corresponding to the engaging apertures 62 of the header plate 60 are formed at the tip of each partitioning wall 71. Furthermore, in the partitioning wall 71, cut-out communication apertures 71*a* are formed at certain intervals along the longitudinal direction.

This header cover 70 is fixed to the header plate 60 in a state that the header cover 70 covers the lower surface side of the header plate 60 and the tip of the engaging protrusion 72 of the partitioning wall 71 is inserted in the engaging aperture 62 of the header plate 60 and caulked. In this state, at the rear-side space of the partitioning wall 71 surrounded by the header plate 60 and the header cover 70, an inflow-side tank 51 of a tube shape extending in the core width direction is formed, while at the front-side space of the partitioning wall 71 an outflow-side tank 11 of a tube shape extending in the core width direction is formed. Furthermore, the inflow-side tank 51 and the outflow-side tank 52 are communicated with each other via communication apertures 71*a* formed in the partition 71.

Then, as shown in FIGS. 18 and 19, the upper and of each heat exchanging tube 6 and 7 of the same core 1 as in the first embodiment is inserted into each tube mounting aperture 21 of the header plate 20 of the upper header member 10 and fixed thereto, while the lower end of the heat exchanging tube 6 and 7 is inserted into each tube mounting aperture 61 of the header plate 60 of the lower header member 50 and fixed thereto.

Since the other structure is essentially the same as in the first embodiment, the duplicate explanation will be omitted by allotting the same reference numeral to the same or corresponding portion.

In this evaporator of the second embodiment, in the same manner as in the first embodiment, the evaporator components are provisionally assembled into a predetermined evaporator configuration, and the provisionally assembled product is collectively brazed in a furnace to thereby integrally connect them.

According to the evaporator of this second embodiment, the same effects as in the first embodiment can be obtained.

Moreover, since an aluminum press-formed plate member is used as the structural member 20, 30, 60 and 70 of each header member 10 and 50, the header structural member 20, 30, 60 and 70 can be continuously manufactured from a coiled aluminum member, resulting in an enhanced productivity.

Furthermore, since the header structure member 20, 30, 60 and 70 is made of a plate member, a brazing sheet having clad materials such as brazing materials or sacrifice materials laminated on at least one side surface thereof can be used as the header structure member 20, 30, 60 and 70, resulting in an enhanced brazability. Especially, in cases where cladding materials are laminated on the external surface side, the corrosion protection nature can be improved by containing zinc (Zn) into the cladding materials to thereby form a sacrifice material layer.

Furthermore, since the partitioning wall 31 and 71 of both the header members 10 and 50, sufficient strength can be secured while decreasing the header height and the wall thickness, resulting in a reduced size and weight. Especially, since the partitioning wall 31 and 71 is formed by folding a plate member, sufficient strength can be secured even if the thickness is thin, which enables to further decrease the size and weight.

In the second embodiment, the refrigerant distributing resistance plate 0.41 and the uneven-distribution-flow preventing resistance plate 42 may be provided in the header member 10 and 50 in the same manner as in the first embodiment.

Furthermore, in this embodiment, although the header plate 20 and 60 and the header cover 30 and 70 constituting the header member 10 and 50 are formed by an aluminum plate respectively, in the present invention, a part of these members may be made of an extruded molded article.

In cases where an extruded molded article is used as a part of header structure member, it is difficult to form a sacrifice layer by itself. Therefore, before subjecting it to collective brazing processing, a flux containing zinc is applied to the extruded molded article. This enables to form a zinc diffusion layer (sacrifice layer) on the external surface, resulting an improved corrosion resistance.

Furthermore, in the second embodiment too, in the same manner as in the first embodiment, the position of the refrigerant inlet and/or the refrigerant outlet, the air take-in direction and the installation direction of the evaporator are not specifically limited.

As mentioned above, according to the first to fourth aspect of the present invention, since the refrigerant passage is formed into a simple U-shape, the refrigerant flow resistance can be decreased. As a result, the refrigerant flow cross-sectional area can be decreased and the tube height of the heat exchanging tube can be decreased. Accordingly, the size, weight and thickness of the evaporator can be reduced. Furthermore, in cases where the tube height is decreased, the number of tubes can be increased without increasing the core size. Therefore, the refrigerant dispersibility can be improved, resulting in improved heat exchanging performance. Especially, according to the evaporator of the third and fourth aspect of the present invention, since the header member is made of a metal press-formed plate, the productivity can be improved and the brazability and corrosion resistance can also be improved by using a brazing sheet.

The fifth to eighth aspect of the present invention specify a manufacturing process of the evaporator of the first to fourth aspect of the present invention. Therefore, the aforementioned evaporator can be manufactured more assuredly.

Furthermore, the ninth and tenth aspects of the present invention specify a header member applicable to the evaporator of the third or fourth aspect of the present invention. Therefore, the aforementioned evaporator can be manufactured more assuredly.

The eleventh to fourteenth aspects of the present invention specify a refrigerant system using the evaporator of the first to fourth aspect of the present invention. Therefore, the aforementioned effects can be obtained more assuredly.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

INDUSTRIAL APPLICABILITY

As mentioned above, the evaporator, the manufacturing method thereof, the header member for evaporators and a refrigeration system can improve heat exchanging performance while reducing the size and weight. Therefore, they can be preferably used for a refrigeration cycle for car air-conditioning system especially.

The invention claimed is:

1. An evaporator, comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-side tank disposed along one end side of said upstream-side heat exchanging tube group;

an outlet-side tank disposed along one end side of said downstream-side heat exchanging tube group; and a refrigerant turning member disposed along the other end side of both said heat exchanging tube groups, wherein each one end of said heat exchanging tubes constituting said upstream-side heat exchanging tube group is connected to said inlet-side tank, while the other end thereof is connected to said refrigerant turning member, wherein each one end of said heat exchanging tubes constituting said downstream-side heat exchanging tube group is connected to said outlet-side tank, while the other end thereof is connected to said refrigerant turning member, whereby refrigerant flowed into said inlet-side tank is introduced into said outlet-side tank via said upstream-side heat exchanging tube group, said refrigerant turning member and said downstream-side heat exchanging tube group, while said refrigerant passing through both said heat exchanging tube groups evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

2. The evaporator as defined in claim 1, wherein said outlet-side tank is provided with uneven-distribution-flow preventing resistance means which prevents uneven-distribution-flow of refrigerant.

3. An evaporator, comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-side tank disposed along one end side of said upstream-side heat exchanging tube group;

an outlet-side tank disposed along one end side of said downstream-side heat exchanging tube group; and a refrigerant turning member disposed along the other end side of both said heat exchanging tube groups, wherein each one end of said heat exchanging tubes constituting said upstream-side heat exchanging tube group is connected to said inlet-side tank, while the other end thereof is connected to said refrigerant turning member, wherein each one end of said heat exchanging tubes constituting said downstream-side heat exchanging tube group is connected to said outlet-side tank, while the other end thereof is connected to said refrigerant turning member, whereby refrigerant flowed into said inlet-side tank is introduced into said outlet-side tank via said upstream-side heat exchanging tube group, said refrigerant turning member and said downstream-side heat exchanging tube group, while said refrigerant passing through both said heat exchanging tube groups evaporates by exchanging heat with ambient air, and wherein said outlet-side tank is provided with uneven-distribution-flow preventing resistance means which prevents uneven-distribution-flow of refrigerant in said outlet-side tank.

4. An evaporator, comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-and-outlet-side header member disposed along one end side of both said heat exchanging tube groups; and refrigerant-turn-side header member disposed along the other end side of both said heat exchanging tube groups, wherein an inside of said inlet-and-outlet-side header member is divided front and rear by a partition into a front-side portion and a rear-side portion, wherein said front-side portion constitutes an inlet-side tank and said rear-side portion constitutes an outlet-side tank, wherein one end of each of said heat exchanging tubes constituting said upstream-side heat exchanging tube group is connected to said inlet-side tank of said inlet-and-outlet-side header member, while the other end thereof is connected to said refrigerant-turn-side header member, wherein one end of each of said heat exchanging tubes constituting said downstream-side heat exchanging tube group is connected to said outlet-side tank of said inlet-and-outlet-side header member, while the other end thereof is connected to said refrigerant-turn-side header member, whereby refrigerant flowed into said inlet-side tank is introduced into said outlet-side tank via said upstream-side heat exchanging tube group, said refrigerant-turn-side member and said downstream-side heat exchanging tube group, while said refrigerant passing through both said heat exchanging tube groups evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

5. The evaporator as recited in claim 4, wherein said inlet-and-outlet-side header member includes an inlet-and-outlet-side header plate to which one end of each of said heat exchanging tubes is fixed in a penetrated manner and an inlet-and-outlet-side header cover attached to said header plate so as to cover one surface side of said header plate.

6. The evaporator as recited in claim 4, wherein said refrigerant-turn-side header member includes a refrigerant-turn-side header plate to which the other end of each of said heat exchanging tubes is fixed in a penetrated manner and a refrigerant-turn-side header cover attached to said header plate so as to cover the other surface of said header plate.

7. The evaporator as recited in claim 4, wherein uneven-distribution-flow preventing resistance means for preventing an uneven-refrigerant-flow is provided within said outlet-side tank of said inlet-and-outlet-side header member.

8. The evaporator as recited in claim 4, wherein said refrigerant distributing resistance means is a refrigerant distributing resistance plate which divides said inlet-side tank into an upper space and a lower space and has a plurality of refrigerant passage apertures formed at intervals along said longitudinal direction of said inlet-side tank.

9. The evaporator as recited in claim 8, wherein said plurality of refrigerant passage apertures of said refrigerant distributing resistance plate include apertures different in size.

10. The evaporator as recited in claim 9, wherein said inlet-and-outlet-side header member has a refrigerant inlet for introducing refrigerant into said inlet-side tank, and wherein said plurality of refrigerant passage apertures of said refrigerant distributing resistance plate are formed so that said refrigerant passage aperture increases in size as it goes away from said refrigerant inlet.

11. The evaporator as recited in claim 10, wherein said refrigerant inlet is formed at a longitudinal middle position of said inlet-side tank, and wherein said refrigerant passage apertures formed in said refrigerant distributing resistance plate and located apart from said refrigerant inlet are formed to have a size larger than a size of said refrigerant passage aperture located near said refrigerant inlet.

12. The evaporator as recited in claim 10, wherein said refrigerant inlet is provided at a longitudinal end portion of said inlet-side tank.

13. The evaporator as recited in claim 4, wherein corresponding heat exchanging tubes of both said heat exchanging tube groups are integrally connected.

14. The evaporator as recited in claim 4, wherein said heat exchanging tube is an extruded tube obtained by extrusion molding.

15. The evaporator as recited in claim 4, wherein a tube height of said heat exchanging tube falls within the range of from 0.75 to 1.5 mm.

16. An evaporator, comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-and-outlet-side header member disposed alone one end side of both said heat exchanging tube groups; and refrigerant-turn-side header member disposed along the other end side of both said heat exchanging tube groups, wherein an inside of said inlet-and-outlet-side header member is divided front and rear by a partition into a front-side portion and a rear-side portion, wherein said front-side portion constitutes an inlet-side tank and said rear-side portion constitutes an outlet-side tank, wherein one end of each of said heat exchanging tubes constituting said upstream-side heat exchanging tube group is connected to said inlet-side tank of said inlet-and-outlet-side header member, while the other end thereof is connected to said refrigerant-turn-side header member, wherein one end of each of said heat exchanging tubes constituting said downstream-side heat exchanging tube group is connected to said outlet-side tank of said inlet-and-outlet-side header member, while the other end thereof is connected to said refrigerant-turn-side header member, whereby refrigerant flowed into said inlet-side tank is introduced into said outlet-side tank via said upstream-side heat exchanging tube group, said refrigerant-turn-side member and said downstream-side heat exchanging tube group, while said refrigerant passing through both said heat exchanging tube groups evaporates by exchanging heat with ambient air, and wherein uneven-distribution-flow preventing resistance means for preventing an uneven-refrigerant-flow in said outlet-side tank is provided within said outlet-side tank of said inlet-and-outlet-side header member.

17. The evaporator as recited in claim 16, wherein said uneven-distribution-flow preventing resistance means is an uneven-distribution-flow preventing resistance plate which divides said outlet-side tank into an upper space and a lower space and has a plurality of refrigerant passage apertures formed at intervals along a longitudinal direction of said inlet-side tank.

18. The evaporator as recited in claim 17, wherein a distance between adjacent refrigerant passage apertures formed in said uneven-distribution-flow preventing resistance plate falls within the range of 1 to 4 times as long as a distance between adjacent heat exchanging tubes.

19. The evaporator as recited in claim 17, wherein said refrigerant passage apertures formed in said uneven-distribution-flow preventing resistance plate are offset from a widthwise central portion of said heat exchanging tube toward a windward side relative to an air introducing direction.

20. The evaporator as recited in claim 17, wherein said inlet-and-outlet-side header member has a refrigerant outlet through which refrigerant flows out of said outlet-side tank, and wherein a cross-sectional area of a refrigerant passage aperture located in the most distant position from said refrigerant outlet among said refrigerant passage apertures formed in said uneven-distribution-flow preventing resistance plate is set to 7 $mm^2$ or less.

21. The evaporator as recited in claim 20, wherein said refrigerant outlet is provided at a longitudinal middle portion of said outlet-side tank.

22. The evaporator as recited in claim 20, wherein said refrigerant outlet is provided at a longitudinal end portion of said outlet-side tank.

23. The evaporator as recited in claim 17, wherein a cross-sectional area between said uneven-distribution-flow preventing resistance plate and an end portion of said heat exchanging tube in said outlet-side tank is 1 to 5 times as large as a passage cross-sectional area of said heat exchanging tube.

24. The evaporator as recited in claim 17, wherein a total cross-sectional area of said refrigerant passage apertures formed in said uneven-distribution-flow preventing resistance plate is larger than a total passage cross-sectional area of said heat exchanging tubes at said downstream-side heat exchanging tube group.

25. The evaporator as recited in claim 17, wherein each of said refrigerant passage apertures formed in said uneven-distribution-flow preventing resistance plate is formed into a round shape.

26. The evaporator as recited in claim 17, wherein said refrigerant passage aperture formed in said uneven-distribution-flow preventing resistance plate is formed into an ellipse shape or a rectangular shape having a major axis along a width direction of said heat exchanging tube.

27. The evaporator as recited in claim 26, wherein said refrigerant-turn-side partition has at a tip portion thereof engaging protrusions at certain intervals along a longitudinal direction thereof, wherein said header plate has at a widthwise middle portion thereof engaging apertures corresponding to said engaging protrusions at certain intervals along a longitudinal direction thereof, and wherein said engaging protrusions are inserted and fixed in said engaging apertures by caulking processing.

28. An evaporator, comprising:

a core including an upstream-side heat exchanging tube group and a downstream-side heat exchanging tube group arranged front and rear, each of said heat exchanging tube group including a plurality of heat exchanging tubes disposed parallel with each other at certain intervals;

an inlet-and-outlet-side header member disposed along one end side of both said heat exchanging tube groups; and a refrigerant-turn-side header member disposed along the other end side of both said heat exchanging tube groups, wherein an inside of said inlet-and-outlet-side header member is divided into an inlet-side tank and an outlet-side tank, wherein said refrigerant-turn-side header member includes at least two press-formed metal plate members, wherein an inside of said refrigerant-turn-side header member is divided into an inflow-side tank and an outflow-side tank by a refrigerant-turn-side partition, and both said tanks being communicated by communication apertures provided in said partition, wherein one end of each of said heat exchanging tubes constituting said upstream-side heat exchanging tube group is connected to said inlet-side tank of said inlet-and-outlet-side header member, while the other end thereof is connected to said inflow-side tank of said refrigerant-turn-side header member, wherein one end of each of said heat exchanging tubes constituting said downstream-side heat exchanging tube group is connected to said outlet-side tank of said inlet-and-outlet-side header member, while the other end thereof is connected to said outflow-side tank of said refrigerant-turn-side header member, whereby refrigerant flowed into said inlet-side tank is introduced into said outlet-side tank via said upstream-side heat exchanging tube group, said inflow-side tank, said apertures, said outflow-side tank and said downstream-side heat exchanging tube group, while said refrigerant passing through both said heat exchanging tube groups evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

29. The evaporator as recited in claim 28, wherein said refrigerant-turn-side header member includes a header plate to which one end of each of said heat exchanging tubes is fixed in a penetrated manner and a header cover attached to said header plate so as to cover one surface side of said header plate, and wherein said refrigerant-turn-side partition is formed by folding a widthwise middle portion of a metal plate member constituting said header cover along a longitudinal direction thereof.

30. The evaporator as recited in claim 28, wherein a thickness of said header cover is thinner than that of said header plate.

31. The evaporator as recited in claim 28, wherein said metal plate member constituting said refrigerant-turn-side header member is formed by an aluminum brazing sheet having an aluminum core and a brazing layer laminated on at least one side of said core.

32. The evaporator as recited in claim 31, wherein said brazing sheet has said brazing layer laminated at an external surface side thereof, and wherein said brazing layer contains zinc.

33. The evaporator as recited in claim 28, wherein said inlet-and-outlet-side header member includes at least two press-formed metal plate members.

34. The evaporator as recited in claim 33, wherein said inlet-and-outlet-side header member has a header plate to which an end portion of each of said exchanging tubes is fixed in a penetrated manner and a header cover attached to said header plate so as to cover one surface side thereof, and wherein said inlet-and-outlet-side partition is formed by folding a widthwise middle portion of a metal plate member constituting said header cover along a longitudinal direction thereof.

35. The evaporator as recited in claim 34, wherein said inlet-and-outlet-side partition has at a tip portion thereof engaging protrusions at certain intervals along a longitudinal direction thereof, wherein said header plate has at a widthwise middle portion thereof engaging apertures corresponding to said engaging protrusions at certain intervals along a longitudinal direction thereof, and wherein said engaging protrusions are inserted in and fixed to said engaging apertures by caulking processing.

36. The evaporator as recited in claim 34, wherein a thickness of said header cover is thinner than that of said header plate.

37. The evaporator as recited in claim 33, wherein said metal plate member constituting said inlet-and-outlet-side header member is formed by an aluminum brazing sheet having a brazing layer laminated on at least one side thereof.

38. The evaporator as recited in claim 37, wherein said brazing sheet has said brazing layer laminated at an external surface side thereof, and wherein said brazing layer contains zinc.

39. An evaporator, comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-and-outlet-side header member disposed along one end side of both said heat exchanging tube groups; and a refrigerant-turn-side header member disposed along the other end side of both said heat exchanging tube groups, wherein said inlet-and-outlet-side header member includes an inlet-and-outlet-side header plate, an inlet-and-outlet-side header cover attached to said header plate so as to cover one surface side of said header plate and a partition for dividing an inside of said inlet-and-outlet-side header member into an inlet-side tank and an outlet-side tank, wherein said refrigerant-turn-side header member includes a refrigerant-turn-side header plate and a refrigerant-turn-side header cover attached to said header plate so as to cover one surface side of said header plate, one of said refrigerant-turn-side header plate and said refrigerant-turn-side header cover being formed by a press-formed metal plate member, and the other thereof being formed by an extruded molded article, wherein one end of each of said heat exchanging tubes constituting said upstream-side heat exchanging tube group is fixed to said inlet-and-outlet-side header plate in a penetrated manner to thereby be connected to said inlet-side tank, while the other end thereof is connected to said refrigerant-turn-side header plate in a penetrated manner, wherein one end of each of said heat exchanging tubes constituting said downstream-side heat exchanging tube group is fixed to said inlet-and-outlet-side header member to thereby be connected to said outlet-side tank, while the other end thereof is connected to said refrigerant-turn-side header member in a predetermined manner, whereby refrigerant flowed into said inlet-side tank is introduced into said outlet-side tank via said upstream-side heat exchanging tube group, said refrigerant-turn-side header member and said downstream-side heat exchanging tube group, while said refrigerant passing through both said heat exchanging tube groups evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

40. The evaporator as recited in claim 39, wherein one of said inlet-and-outlet-side header plate and said inlet-and-outlet-side header cover is formed by a press-formed metal plate member and the other thereof is formed by an extruded molded article.

41. A method of manufacturing an evaporator, the method comprising:

a step of preparing a plurality of heat exchanging tubes constituting an upstream-side heat exchanging tube group and a downstream-side heat exchanging tube group to be disposed front and rear; a step of preparing an inlet-side tank to be disposed along one end side of said upstream-side heat exchanging tube group;

a step of preparing an outlet-side tank to be disposed along one end side of said downstream-side heat exchanging tube group;

a step of preparing a refrigerant turning member to be disposed along the other end side of both said heat exchanging tubes groups;

a step of brazing one end of each of said heat exchanging tubes constituting said upstream-side heat exchanging tube group to said inlet-side tank;

a step of brazing the other end of each of said heat exchanging tubes constituting said upstream-side heat exchanging tube group to said refrigerant turning member;

a step of brazing one end of each of said heat exchanging tubes constituting said downstream-side heat exchanging tube group; and a step of brazing the other end of each of said heat exchanging tubes constituting said downstream-side heat exchanging tube group to said refrigerant turning member;

wherein refrigerant flowed into said inlet-side tank is introduced into said outlet-side tank by passing through said upstream-side heat exchanging tube group, said refrigerant turning member and said downstream-side heat exchanging tube group, wherein said refrigerant passing through both said heat exchanging tube groups constitutes a refrigerant circuit in which said refrigerant evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

42. The method of manufacturing an evaporator as recited in claim 41, wherein said brazing steps are collectively performed by furnace brazing processing.

43. A method of manufacturing an evaporator, the method comprising:

a step of preparing heat exchanging tubes constituting an upstream-side heat exchanging tube group and a downstream-side heat exchanging tube group to be disposed front and rear;

a step of preparing an inlet-and-outlet-side header member to be disposed along one end side of both said heat exchanging tube groups, wherein an inside of said header member is divided by a partition front and rear into one side space constituting an inlet-side tank and the other side space constituting an outlet-side tank;

a step of preparing a refrigerant-turn-side header member to be disposed along the other end side of both said heat exchanging tube groups;

a step of brazing one end of each of said heat exchanging tubes constituting said upstream-side heat exchanging tube group to an inlet-side tank of said inlet-and-outlet-side header;

a step of brazing the other end of each of said heat exchanging tubes constituting said upstream-side heat exchanging tube group to said refrigerant-turn-side header member;

a step of brazing one end of each of said heat exchanging tubes constituting said downstream-side heat exchanging tube group to said outlet-side tank of said inlet-and-outlet-side header; and a step of brazing the other end of each of said heat exchanging tubes of said downstream-side heat exchanging tube group to said refrigerant-turn-side header member;

wherein refrigerant flowed into said inlet-side tank is introduced into said outlet-side tank by passing through said upstream-side heat exchanging tube group, said refrigerant-turn-side header member and said downstream-side heat exchanging tube group, wherein said refrigerant passing through both said heat exchanging tube groups constitutes a refrigerant circuit in which said refrigerant evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

44. The method of manufacturing an evaporator as recited in claim 43, wherein said brazing steps are collectively performed by furnace brazing processing.

45. A method of manufacturing an evaporator, the method comprising:

a step of preparing heat exchanging tubes constituting an upstream-side heat exchanging tube group and a downstream-side heat exchanging tube group to be disposed front and rear;

a step of preparing an inlet-and-outlet-side header member to be disposed along one end of both said heat exchanging tube groups, an inside of said header member being divided into an inlet-side tank and an outlet-side tank;

a step of preparing a refrigerant-turn-side header member to be disposed along the other end side of both said heat exchanging tube groups, said refrigerant-turn-side header member including at least two press-formed metal plate members, and an inside of said header member being divided by a refrigerant-turn-side partition into an inflow-side tank and an outflow-side tank, and said both tanks being communicated with each other via communication apertures formed in said partition;

a step of brazing one end of each of said heat exchanging tubes constituting said upstream-side heat exchanging tube group to an inlet-side tank of said inlet-and-outlet-side header;

a step of brazing the other end of each of said heat exchanging tubes constituting said upstream-side heat exchanging tube group to an inflow-side tank of said refrigerant-turn-side header member;

a step of brazing one end of each of said heat exchanging tubes constituting said downstream-side heat exchanging tube group to said outlet-side tank of said inlet-and-outlet-side header; and a step of brazing the other end of each of said heat exchanging tubes of said downstream-side heat exchanging tube group to an outflow-side tank of said refrigerant-turn-side header member;

wherein refrigerant flowed into said inlet-side tank is introduced into said outlet-side tank by passing through said upstream-side heat exchanging tube group, said inflow-side tank, said communication apertures, said outflow-side tank and said downstream-side heat exchanging tube group, wherein said refrigerant passing through both said heat exchanging tube groups constitutes a refrigerant circuit in which said refrigerant evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

46. The method of manufacturing an evaporator as recited in claim 45, wherein said brazing steps are collectively performed by furnace brazing processing.

47. A method of manufacturing an evaporator, the method comprising:

a step of preparing heat exchanging tubes constituting an upstream-side heat exchanging tube group and a downstream-side heat exchanging tube group to be disposed front and rear;

a step of preparing an inlet-and-outlet-side header member to be disposed along one end of both said heat exchanging tube groups, wherein said header member includes an inlet-and-outlet-side header plate, an inlet-and-outlet-side header cover attached to said header plate so as to cover one surface side thereof and a partition for dividing an inside of said inlet-and-outlet-side header member into an inlet-side tank and an outlet-side tank;

a step of preparing a refrigerant-turn-side header member to be disposed along the other end side of both said heat exchanging tube groups, wherein said refrigerant-turn-side header member includes a refrigerant-turn-side header plate refrigerant-turn-side header cover attached to said header plate so as to cover one side surface thereof, one of said refrigerant-turn-side header plate and said refrigerant-turn-side header cover being made of a press-formed metal plate, and the other thereof being made of an extruded molded article;

a step of brazing one end of each of said heat exchanging tubes constituting said upstream-side heat exchanging tube group to said header plate of said inlet-and-outlet-side header to thereby be connected to said inlet-side tank;

a step of brazing the other end of each of said heat exchanging tubes constituting said upstream-side heat exchanging tube group to said header plate of said refrigerant-turn-side header member;

a step of brazing one end of each of said heat exchanging tubes constituting said downstream-side heat exchanging tube group to said header plate of said inlet-and-outlet-side header to thereby be connected to said outlet-side tank; and a step of brazing the other end of each of said heat exchanging tubes constituting said downstream-side heat exchanging tube group to said header plate of said refrigerant-turn-side header member, and wherein refrigerant flowed into said inlet-side tank is introduced into said outlet-side tank by passing through said upstream-side heat exchanging tube group, said refrigerant turn-side header member and said downstream-side heat exchanging tube group, wherein said refrigerant passing through both said heat exchanging tube groups constitutes a refrigerant circuit in which said refrigerant evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

48. The method of manufacturing an evaporator as recited in claim 47, wherein said brazing steps are collectively performed by furnace brazing processing.

49. The method of manufacturing an evaporator as recited in claim 48, further comprising a step of forming a zinc diffusion layer on a surface of each of said header members by applying a flux containing zinc on said surface before performing said furnace brazing processing.

50. An inlet-and-outlet-side header member for an evaporator with a core including an upstream-side heat exchanging tube group and a downstream-side heat exchanging tube group disposed front and rear, each of said heat exchanging tube groups including a plurality of heat exchanging tubes arranged in parallel with each other at certain intervals, said header member comprising:

a header plate for fixing an end portion of each of said heat exchanging tubes in a penetrated manner;

a header cover attached to said header plate so as to cover one surface side thereof; and a partition for forming an inlet-side tank and an outlet-side tank by dividing a hollow portion surrounded by said header plate and said header cover front and rear;

wherein at least one of said header plate and the said header cover is a press-formed metal plate, and wherein refrigerant flowed into said inlet-side tank is introduced into said upstream-side heat exchanging tube group, while refrigerant passing through said downstream-side heat exchanging tube group is introduced into said outlet-side tank, and wherein said inlet-side tank is provided with refrigerant distributing resistance means configured to distribute said refrigerant evenly into said heat exchanging tubes constituting said downstream-side heat exchanging tube group.

51. The inlet-and-outlet-side header member for an evaporator as recited in claim 50, wherein both said header plate and said header cover are formed by a press-formed metal plate member, and wherein said partition is integrally formed with said header cover by folding a widthwise middle portion of said metal plate, constituting said header cover along a longitudinal direction thereof.

52. The inlet-and-outlet-side header member for an evaporator as recited in claim 50, wherein one of said header plate and said header cover is a press-formed metal plate, and the other thereof is an extruded molded article.

53. A refrigeration system in which refrigerant compressed by a compressor is condensed by a condenser into a condensed refrigerant, then said condensed refrigerant is passed through a decompressing device into a decompressed refrigerant, and thereafter said decompressed refrigerant is evaporated by an evaporator and then returns to said compressor, said evaporator comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-side tank disposed along one end side of said upstream-side heat exchanging tube group;

an outlet-side tank disposed along one end side of said downstream-side heat exchanging tube group; and a refrigerant turning member disposed along the other end side of both said heat exchanging tube groups, wherein each one end of said heat exchanging tubes constituting said upstream-side heat exchanging tube group is connected to said inlet-side tank, while the other end thereof is connected to said refrigerant turning member, and wherein each one end of said heat exchanging tubes constituting said downstream-side heat exchanging tube group is connected to said outlet-side tank, while the other end thereof is connected to said refrigerant turning member, whereby refrigerant flowed into said inlet-side tank is introduced into said outlet-side tank via said upstream-side heat exchanging tube group, said refrigerant turning member and said downstream-side heat exchanging tube group, while said refrigerant passing through both said heat exchanging tube groups evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

54. A refrigeration system in which refrigerant compressed by a compressor is condensed by a condenser into a condensed refrigerant, then said condensed refrigerant is passed through a decompressing device into a decompressed refrigerant, and thereafter said decompressed refrigerant is evaporated by an evaporator and then returns to said compressor, an evaporator, comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-and-outlet-side header member disposed along one end side of both said heat exchanging tube groups; and a refrigerant-turn-side header member disposed along the other end side of both said heat exchanging tube groups, wherein an inside of said inlet-and-outlet-side header member is divided front and rear by a partition into a front-side portion and a rear-side portion, wherein said front-side portion constitutes an inlet-side tank and said rear-side portion constitutes an outlet-side tank, wherein one end of each of said heat exchanging tubes constituting said upstream-side heat exchanging tube group is connected to said inlet-side tank of said inlet-and-outlet-side header member, while the other end thereof is connected to said refrigerant-turn-side header member, and wherein one end of each of said heat exchanging tubes constituting said downstream-side heat exchanging tube group is connected to said outlet-side tank of said inlet-and-outlet-side header member, while the other end thereof is connected to said refrigerant-turn-side header member, whereby refrigerant flowed into said inlet-side tank is introduced into said outlet-side tank via said upstream-side heat exchanging tube group, said refrigerant-turn-side member and said downstream-side heat exchanging tube group, while said refrigerant passing through both said heat exchanging tube groups evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

55. A refrigeration system in which refrigerant compressed by a compressor is condensed by a condenser into a condensed refrigerant, then said condensed refrigerant is passed through a decompressing device into a decompressed refrigerant, and thereafter said decompressed refrigerant is evaporated by an evaporator and then returns to said compressor, an evaporator, comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-and-outlet-side header member disposed along one end side of both said heat exchanging tube groups; and a refrigerant-turn-side header member disposed along the other end side of both said heat exchanging tube groups, wherein an inside of said inlet-and-outlet-side header member is divided into an inlet-side tank and an outlet-side tank, wherein said refrigerant-turn-side header member includes at least two press-formed metal plate members, wherein an inside of said refrigerant-turn-side header member is divided into an inflow-side tank and an outflow-side tank by a refrigerant-turn-side partition, and both said tanks being communicated by communication apertures provided in said partition, wherein one end of each of said heat exchanging tubes constituting said upstream-side heat exchanging tube group is connected to said inlet-side tank of said inlet-and-outlet-side header member, while the other end thereof is connected to said inflow-side tank of said refrigerant-turn-side header member, and wherein one end of each of said heat exchanging tubes constituting said downstream-side heat exchanging tube group is connected to said outlet-side tank of said inlet-and-outlet-side header member, while the other end thereof is connected to said outflow-side tank of said refrigerant-turn-side header member, whereby refrigerant flowed into said inlet-side tank is introduced into said outlet-side tank via said upstream-side heat exchanging tube group, said inflow-side tank, said apertures, said outflow-side tank and said downstream-side heat exchanging tube group, while said refrigerant passing through both said heat exchanging tube groups evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

56. A refrigeration system in which refrigerant compressed by a compressor is condensed by a condenser into a condensed refrigerant, then said condensed refrigerant is passed through a decompressing device into a decompressed refrigerant, and thereafter said decompressed refrigerant is evaporated by an evaporator and then returns to said compressor, an evaporator, comprising:

a core including an upstream-side heat exchanging tube group and a downstream-side heat exchanging tube group arranged front and rear, each of said heat exchanging tube groups including a plurality of heat exchanging tubes disposed parallel with each other at certain intervals;

an inlet-and-outlet-side header member disposed along one end side of both said heat exchanging tube groups; and a refrigerant-turn-side header member disposed along the other end side of both said heat exchanging tube groups, wherein said inlet-and-outlet-side header member includes an inlet-and-outlet-side header plate, an inlet-and-outlet-side header cover attached to said header plate so as to cover one surface side of said header plate and a partition for dividing an inside of said inlet-and-outlet-side header member into an inlet-side tank and an outlet-side tank, wherein said refrigerant-turn-side header member includes a refrigerant-turn-side header plate and a refrigerant-turn-side header cover attached to said header plate so as to cover one surface side of said header plate, one of said refrigerant-turn-side header plate and said refrigerant-turn-side header cover being formed by a press-formed metal plate member, and the other thereof being formed by an extruded molded article, wherein one end of each of said heat exchanging tubes constituting said upstream-side heat exchanging tube group is fixed to said inlet-and-outlet-side header plate in a penetrated maimer to thereby be connected to said inlet-side tank, while the other end thereof is connected to said refrigerant-turn-side header plate in a penetrated manner, wherein one end of each of said heat exchanging tubes constituting said downstream-side heat exchanging tube group is fixed to said inlet-and-outlet-side header member to thereby be connected to said outlet-side tank, while the other end thereof is connected to said refrigerant-turn-side header member in a predetermined manner, whereby refrigerant flowed into said inlet-side tank is introduced into said outlet-side tank via said upstream-side heat exchanging tube group, said refrigerant-turn-side header member and said downstream-side heat exchanging tube group, while said refrigerant passing through both said heat exchanging tube groups evaporates by exchanging heat with ambient air, and wherein said inlet-side tank is provided with refrigerant distributing resistance means configured to distribute said refrigerant evenly into said heat exchanging tubes constituting said downstream-side heat exchanging tube group.

* * * * *

UNITED STATES PATENT AND TRADEMARK OFFICE

CERTIFICATE OF CORRECTION

PATENT NO. : 7,066,243 B2
APPLICATION NO. : 10/480259
DATED : June 27, 2006
INVENTOR(S) : Hirofumi Horiuchi et al.

It is certified that error appears in the above-identified patent and that said Letters Patent is hereby corrected as shown below:

Column 28, line 31, change “alone” to -- along --

Column 30, line 52, change “28” to -- 29 --

Coulmn 35, line 13, delete “and”

Column 38, line 56, change “maimer” to -- manner --

Signed and Sealed this

Ninth Day of January, 2007

JON W. DUDAS
*Director of the United States Patent and Trademark Office*